US010697106B2

(12) United States Patent
Xi et al.

(10) Patent No.: US 10,697,106 B2
(45) Date of Patent: Jun. 30, 2020

(54) WASHING MACHINE AND WASHING DRUM THEREOF

(71) Applicant: TCL HOME APPLIANCES (HEFEI) CO., LTD., Hefei, Anhui (CN)

(72) Inventors: Lei Xi, Hefei (CN); Chouguo Zhou, Hefei (CN); Fei Zhao, Hefei (CN); Jian Wang, Hefei (CN); Xiaowei Xie, Hefei (CN)

(73) Assignee: TCL HOME APPLIANCES (HEFEI) CO., LTD., Hefei, Anhui (CN)

( * ) Notice: Subject to any disclaimer, the term of this patent is extended or adjusted under 35 U.S.C. 154(b) by 0 days.

(21) Appl. No.: 15/806,345

(22) Filed: Nov. 8, 2017

(65) Prior Publication Data

US 2018/0073179 A1 Mar. 15, 2018

Related U.S. Application Data

(63) Continuation of application No. PCT/CN2016/074589, filed on Feb. 25, 2016.

(30) Foreign Application Priority Data

| | | |
|---|---|---|
| Dec. 29, 2015 | (CN) | 2015 1 1022999 |
| Dec. 29, 2015 | (CN) | 2015 2 1131395 U |
| Dec. 29, 2015 | (CN) | 2015 2 1131417 U |
| Dec. 29, 2015 | (CN) | 2015 2 1131573 U |

(51) Int. Cl.

| | |
|---|---|
| ***D06F 37/14*** | (2006.01) |
| ***D06F 23/04*** | (2006.01) |
| ***D06F 37/26*** | (2006.01) |
| ***D06F 37/12*** | (2006.01) |
| ***D06F 37/30*** | (2020.01) |
| ***D06F 39/08*** | (2006.01) |
| *D06F 31/00* | (2006.01) |
| *D06F 17/10* | (2006.01) |

(52) U.S. Cl.

CPC ..... *D06F 37/14* (2013.01); *D06F 23/04* (2013.01); *D06F 37/12* (2013.01); *D06F 37/26* (2013.01); *D06F 37/304* (2013.01); *D06F 39/083* (2013.01); *D06F 17/10* (2013.01); *D06F 31/00* (2013.01)

(58) Field of Classification Search

CPC ..... D06F 37/14

See application file for complete search history.

(56) References Cited

FOREIGN PATENT DOCUMENTS

| | | |
|---|---|---|
| CN | 202124754 | 1/2012 |
| CN | 204780307 | 11/2015 |
| CN | 205275964 | 6/2016 |
| JP | S5928994 | 2/1984 |

(Continued)

*Primary Examiner* — Jason Y Ko

(74) *Attorney, Agent, or Firm* — Winston Hsu

(57) ABSTRACT

Provided are a washing machine and a washing drum thereof. The washing drum comprises a large container and a small container. The small container is detachably disposed in the large container, and an opening of the small container and an opening of the large container are positioned opposite to each other. In a washing process, clothes needing special care can be placed in the small container so that water in the large container does not enter the small container, thereby realizing separating washing of the clothes needing special care. If there are no clothes needing special care, the small container can be detached from the large container to perform a normal washing operation.

19 Claims, 23 Drawing Sheets

(56) References Cited

FOREIGN PATENT DOCUMENTS

| | | | |
|---|---|---|---|
| JP | S59-168280 | U | 11/1984 |
| JP | S60-080490 | A | 5/1985 |
| JP | S60253490 | | 12/1985 |
| JP | H08-299670 | A | 11/1996 |

WASHING MACHINE AND WASHING DRUM THEREOF

CROSS REFERENCE TO RELATED APPLICATIONS

This application is a continuation of International Application No. PCT/CN2016/074589, filed Feb. 25, 2016.

BACKGROUND OF THE INVENTION

1. Field of the Invention

The present disclosure relates to a technology field of washing machines, and in particular to a washing machine and a washing drum thereof.

2. Description of the Prior Art

With the increasing and developing of the society, people pay more attention to quality of their lives. In a process of washing clothes, for our cleanness, separating different clothes to wash can avoid cross contamination, such as children's clothes or underclothes separated from other clothes. Whereas, in a conventional washing machine that has only one washing drum, to realize the separation of special clothes, people always separate the clothes to wash several times, to a certain extent the cross contamination may be avoided but some residues cannot be avoided to exist inside the washing machine. In a process of next washing that the residues may attach to the clothes, in all likelihood skin allergy is generated.

SUMMARY OF THE INVENTION

The present disclosure relates to a washing drum, aims to realize separate washing of the clothes needing special care.

To realize the above aim, the present disclosure relates to a washing drum including a large container and a small container, the small container is detachably disposed in the large container, an opening of the small container and an opening of the large container are positioned opposite to each other; between an external wall of the small container and an internal wall of the large container has a gap.

Preferably, the large container includes a first opening end and a first bottom part positioned opposite to each other.

The washing drum further includes a wave wheel positioned on the first bottom part; a side of the wave wheel, away from the first bottom part, protrudes to form a positioning column; a sectional shape of the positioning column is non-circular.

The small container includes a second opening end and a second bottom part positioned opposite to each other.

In which, the second bottom part is concaved towards the second opening end to form a groove that is fitted with the positioning column, enabling the positioning column to be inserted into the groove; or the small container and the wave wheel are formed integrally, the second bottom part of the small container is positioned on the wave wheel and the wave wheel is detachably positioned on the first bottom part.

Preferably, the positioning column is a spline, or the sectional shape of the positioning column is polygon.

Preferably, a bevel of the small container tilts outwards, a diameter of the bevel of the small container is increasing from the second bottom part to the second opening end.

Preferably, the positioning column includes a positioning hole, a fastener is provided to dispose the wave wheel on the first bottom part via the positioning hole.

Preferably, a height of the positioning column is more than or equal to 70 mm.

Preferably, the washing drum further includes an anti-slip mat positioned between an exterior of the second bottom part of the small container and the wave wheel.

Preferably, a water string is convexly positioned on a side of the wave wheel that the side thereof faces with the first bottom part; a receiving groove fitted with the water string is concavely positioned on a side of the second bottom part that the side thereof faces with the wave wheel.

Preferably, a bevel of the small container includes convex ribs.

Preferably, the number of the convex ribs is multiple, multiple convex ribs are interval arranged on a periphery of the bevel of the small container, each convex rib extends along an axial direction of the bevel of the small container.

Preferably, the large container includes a first opening end and a first bottom part positioned opposite to each other.

The washing drum further includes a wave wheel positioned on the first bottom part, the wave wheel has mounting holes;

The small container has a second opening end and a second bottom part positioned opposite to each other. The second bottom part is positioned on the wave wheel, the small container is detachably positioned on the wave wheel, the second opening end of the small container has a pull ring that can be pivoted.

The washing drum further includes a hinge mechanism including a slider, a connecting rod and a spring. The slider is set in the mounting hole, one end of the connecting rod is hinged with the slider, the other end of the connecting rod is connected to the pull ring; one end of the spring is fixed on a periphery of a bevel of the small container, the other end of the spring is connected with the connecting rod.

Preferably, the hinge mechanisms have two, two hinge mechanisms are respectively disposed on two sides of the pull ring.

Preferably, the number of the sliders in every hinge mechanism is two, the connecting rod includes a first connecting rod, a second connecting rod and a third connecting rod. Each slider is hinged with an end of the first connecting rod, the other end of the first connecting rod is hinged with an end of the second connecting rod, the other end of the second connecting rod is hinged with an end of the third connecting rod, the other end of the third connecting rod is hinged with the pull ring, the sliders in every hinge mechanism and the mounting holes are set opposite to each other. An end of the spring is connected with the third connecting rod.

Preferably, the bevel of the small container tilts outwards; a diameter of the bevel of the small container is increasing from the second bottom part to the second opening end.

Preferably, a water string is convexly disposed on a side of the wave wheel that the side thereof is away from the first bottom part; a receiving groove fitted with the water string is concavely positioned on a side of the second bottom part that the side thereof faces with the wave wheel.

Preferably, mounting holes are disposed on a lateral surface of the water string.

Preferably, the washing drum further includes an anti-slip mat disposed between external of the second bottom part of the small container and the wave wheel.

Preferably, the bevel of the small container includes convex ribs.

Preferably, the number of the convex ribs is multiple, multiple convex ribs are interval arranged on the periphery of the bevel of the small container, each convex rib extends along an axial direction of the bevel of the small container.

Preferably, the large container includes the first opening end and the first bottom part positioned opposite to each other.

The washing drum further includes a wave wheel positioned on the first bottom part, a mixing column is convexly positioned on a side of the wave wheel that the side thereof faces away from the first bottom part. Multiple leaves are convexly positioned on a periphery wall of the mixing column.

The small container has a second opening end and a second bottom part positioned opposite to each other; the second bottom part, near to the second opening end, is concaved to form a groove fitted with the mixing column and card slots fitted with the leaves; the mixing column and the leaves are inserted into the corresponding groove and card slots.

Preferably, each leave is evenly positioned on the periphery wall of the mixing column.

Preferably, an end of the leave, near to the wave wheel, is integrally connected to the wave wheel, and extends outwards along an axis of the wave wheel.

Preferably, the small container includes a container body and a first locking mechanism, the container body includes a container wall and a container bottom connected with each other integrally; multiple first ribs are convexly positioned inside the container wall, multiple second ribs are convexly positioned inside the container bottom; the first locking mechanism is positioned at a middle of the container bottom.

Preferably, the first locking mechanism includes a locking shell and a locking member fixedly connected with each other; an accommodating cavity is positioned inside the locking shell; the container bottom includes a via hole communicated with the accommodating cavity, the locking member is inserted into the accommodating cavity.

Preferably, a section of the container wall is shaped as circular;

Preferably, a diameter of the container wall is gradually decreasing from an end thereof away from the container bottom, to the other end thereof near to the container bottom.

Preferably, the first ribs are positioned inside the container wall along an axial direction of the container body.

Preferably, the first ribs are interval positioned inside the container wall.

Preferably, the container bottom protrudes along an outside of the container wall to form an outer wave wheel; third ribs are convexly disposed on the outer wave wheel. Washing tanks are positioned on an outside of the container wall.

Preferably, the first locking mechanism includes a locking shell and a locking member fixedly connected with each other; an accommodating cavity is positioned inside the locking shell; the container bottom includes a via hole communicated with the accommodating cavity; the locking member is inserted into the accommodating cavity.

Preferably, a section of the container wall is shaped as circular;

Preferably, a diameter of the container wall is gradually decreasing from an end thereof away from the container bottom, to the other end thereof near to the container bottom.

Preferably, the washing tanks are concavely positioned on an outside of the container wall.

Preferably, each of the washing tanks is set corresponding with each of the second ribs.

A washing machine is further disclosed, including a case of the washing machine, a washing drum, a first power mechanism, a first control device, a second power mechanism and a second control device, the washing drum is disposed in the washing drum, of which, the washing drum includes a large container and a small container. The small container is detachably disposed in the large container, an opening of the small container and an opening of the large container are disposed opposite to each other. Between an external wall of the small container and an internal wall of the large container has a gap. The first control device controls the first power mechanism to drive the large container to rotate. The second control device controls the second power mechanism to drive the small container to rotate.

A washing mechanism is further disclosed, including a drive shaft, a drive motor and a washing drum, the washing drum includes a large container and a small container, the small container is detachably disposed in the large container, an opening of the small container and an opening of the large container are disposed opposite to each other; between an external wall of the small container and an internal wall of the large container has a gap; the small container includes a container body and a first locking mechanism, the container body includes a container wall and a container bottom connected integrally; multiple first ribs are convexly disposed in the container wall and multiple second ribs are convexly disposed in the container bottom; the first locking mechanism is disposed at the middle of the container bottom; the drive shaft is connected with the drive motor; the small container is disposed in the large container, coaxial with the large container; the first locking mechanism is detachably locked with the drive shaft.

Preferably, the first locking mechanism includes a locking shell and a locking member; the locking shell and the container bottom are fixedly connected; inside the locking shell has an accommodating cavity; the container bottom has a via hole, the drive shaft is passing through the via hole then inserted into the accommodating cavity; an end of the drive shaft that the end thereof is inserted into the accommodating cavity has a spline or a positioning recess; the locking member is inserted into the accommodating cavity, and the locking member is connected with the drive shaft.

Preferably, the locking member includes a fixing pedestal and two fixing blocks positioned on the fixing pedestal; two sides of the fixing blocks, facing with each other, are propped to two sides of the spline of the drive shaft, or propped inside the positioning recess; the other two sides of the fixing blocks, are propped to the walls of the accommodating cavity.

Preferably, a large wave wheel is provided, the large wave has a second locking mechanism, the second locking mechanism is detachably locked with the drive shaft.

The technical scheme of the present disclosure by means of a separate small container, the small container and large container can be detachably assembled to form a container-in-container structure. In a washing process that the clothes needing special care are positioned into the small container, a purpose of separately washing the clothes needing special care is realized. If there is no need of washing the clothes needing special care, the small container can be disassembled from the large container, to realize the washing of normal clothes.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only about some embodiments of the present disclosure, and persons of ordinary skill in the art can derive other drawings from the accompanying drawings without creative efforts.

Objective achieving, function features, and advantages of the present disclosure are further described with reference to the embodiments and the accompany drawings.

DETAILED DESCRIPTION

Technical solutions of the present disclosure are further described in detail with reference to the accompanying drawings and embodiments. It is to be understood that the specific embodiments described herein are merely used for describing the present disclosure, but are not intended to limit the present disclosure.

It needs to be understood that, when an element is regarded as "connected with/to" another element, it may be directly carried on another element or also has a centering element. When one element is regarded as "connected with/to" another element, it may be directly connected with another element or probably has the centering element. In the present disclosure, the terms "perpendicular", "horizontal", "left", "right" and other similar expressions are just for a purpose of interpretation, but not being limited within a sole embodiment.

Unless otherwise defined, the meaning of all the technical and scientific terms in the present disclosure belongs to the same meaning understood by the technical personnel in the technical field of the present disclosure. The terms utilized by the present disclosure are just used for describing specific purposes of the embodiments, not aims to limit the present disclosure. Each technical features in above embodiments can be randomly combined. To describe simply, all possible combinations of each technical feature in the above embodiment can be described, however, as long as all combinations of those technical features have no contradictions, which should be regarded as within the scope of the present disclosure.

The present disclosure provides a washing drum of the washing machine that includes a large container and a small container. The small container is detachably disposed in the large container, and an opening of the small container and an opening of the large container are positioned opposite to each other. Between an external wall of the small container and an internal wall of the large container has a gap. When the small container is disposed in the large container, the clothes may be set in the small container for separate washing, meanwhile, the gap space between the large container and the small container may also wash clothes, thus the water in the large container won't flow into the small container so as to separate the clothes in the small container from the clothes in the large container. When there is no need of separate washing, the small container may be detached from the large container, and just the large container is used to wash normal clothes. Next several specific embodiments related to the washing drum of the present disclosure will be interpreted in detail.

Figure 1:
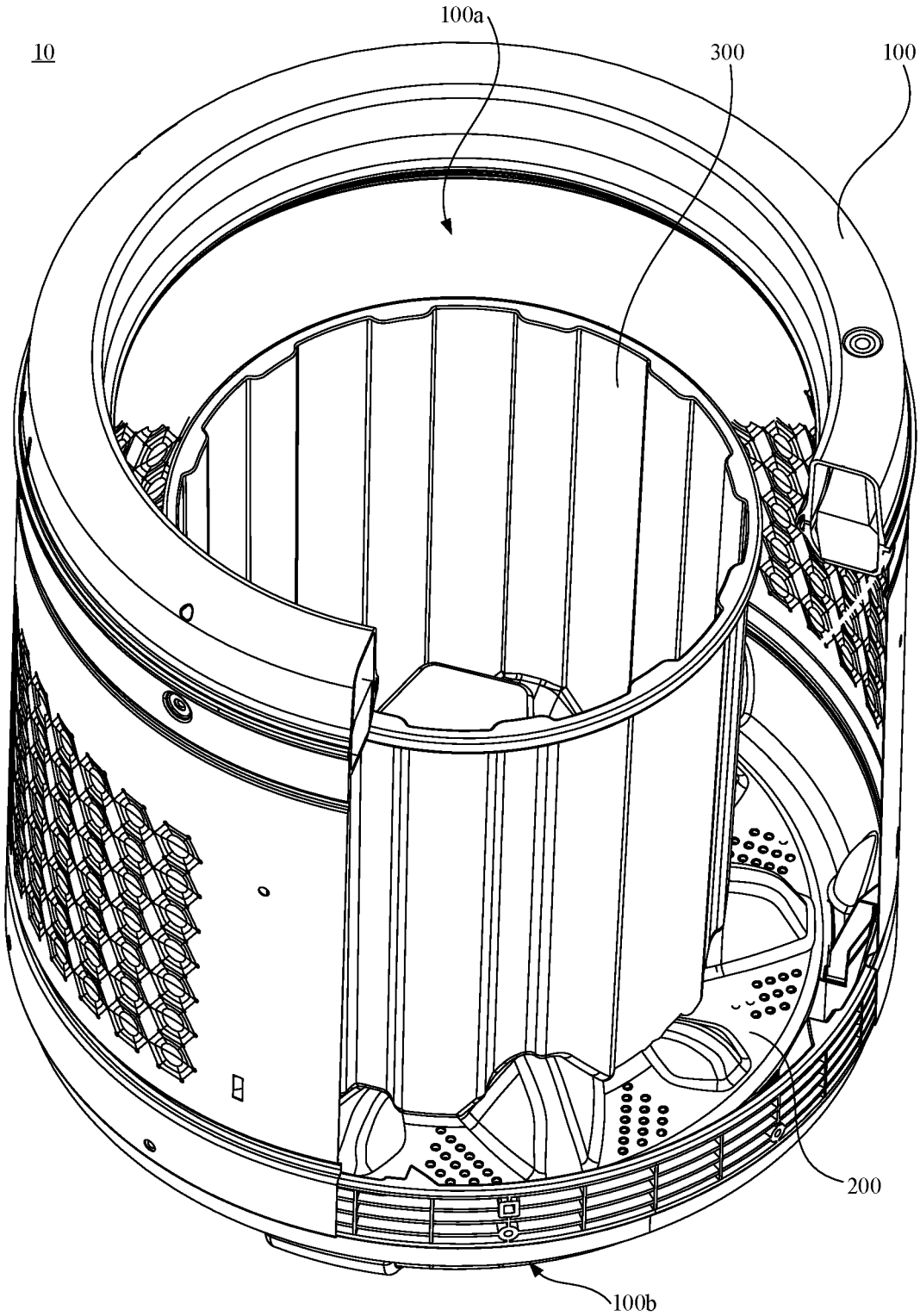
FIG. 1 is a structural diagram of a washing drum according to the first embodiment of the present disclosure.

With reference to FIGS. 1 to 6, FIGS. 1 to 6 are figures of the first embodiment of the present disclosure. The washing machine of the first embodiment includes a case of the washing machine and a washing drum 10 (as shown in FIG. 1), the washing drum 10 of the embodiments may realize separating washing of clothes needing special care. The embodiment will interpret it, taking a washing machine as an example.

The washing drum 10 is disposed in the case of the washing machine. The washing drum 10 is configured for accommodating the clothes needing washing, water for washing clothes and laundry detergents etc. A machine cover is disposed on top of the case of the washing machine, also pivoted with the top of the case of the washing machine.

Figure 2:
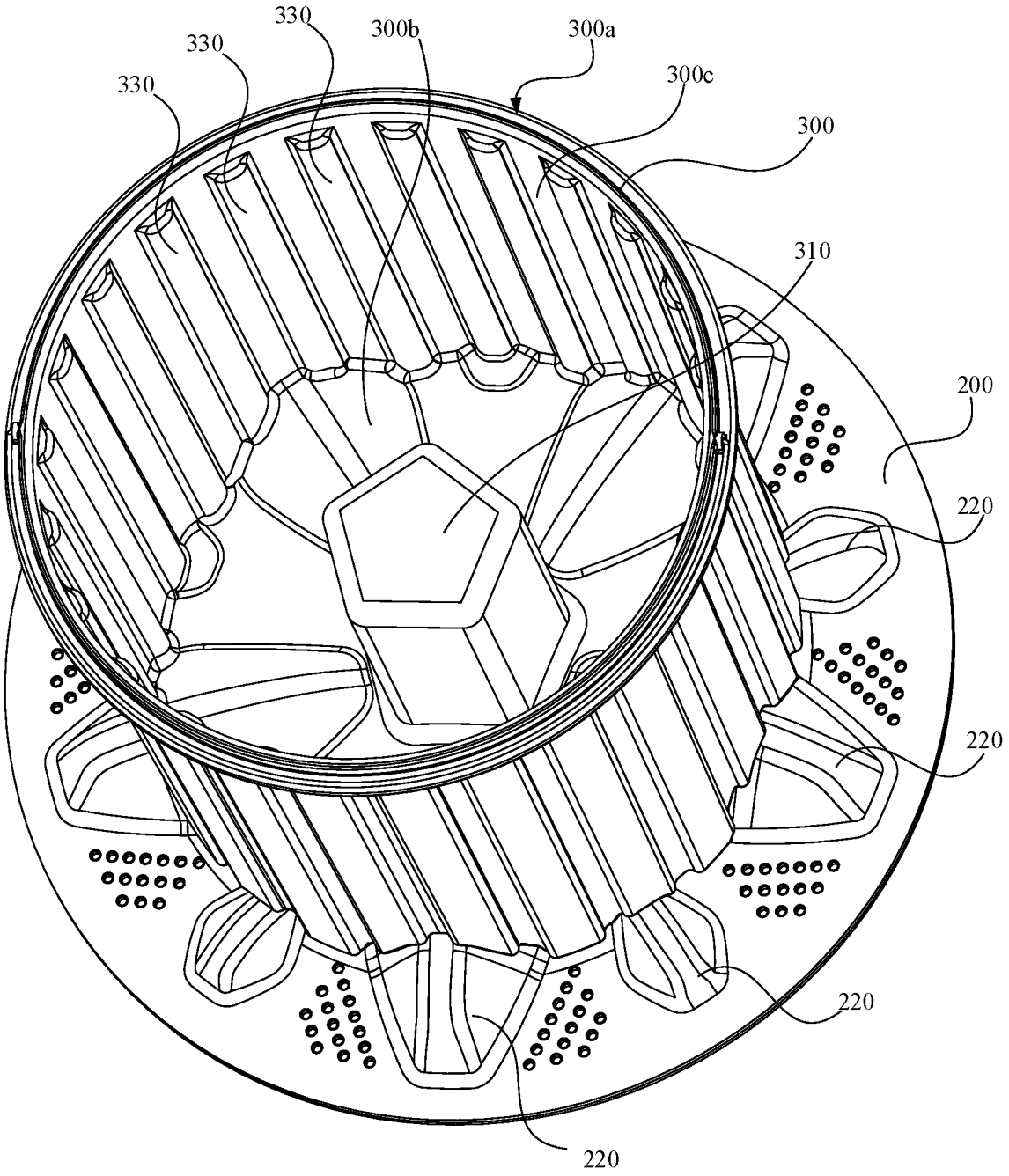
FIG. 2 is a schematic diagram for assembling a wave wheel and a small container in FIG. 1.
Figure 3:
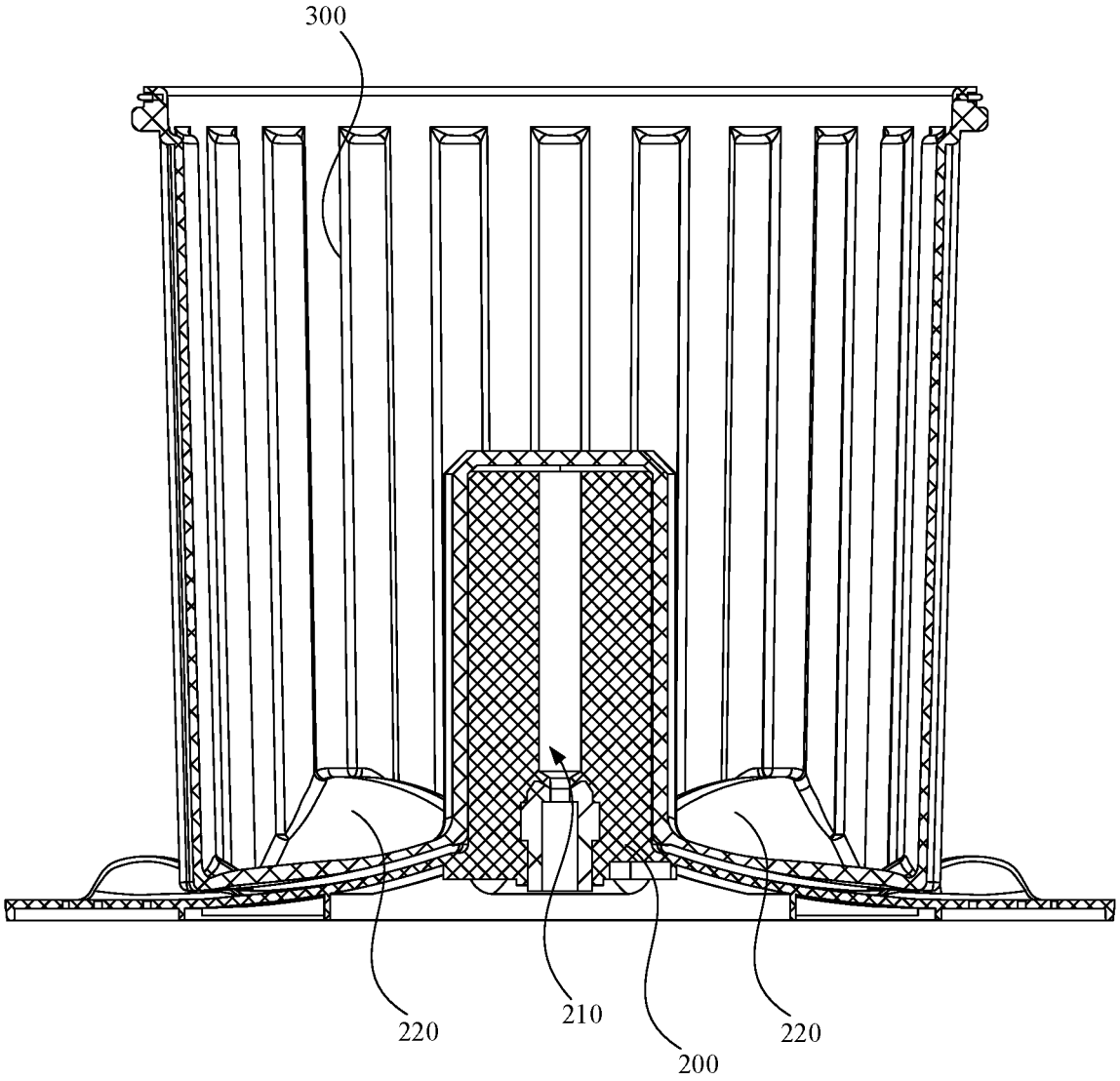
FIG. 3 is a sectional view of the wave wheel and the small container in FIG. 2.

With reference to FIGS. 2 to 3, the washing drum 10 includes a large container 100, a wave wheel 200 and a small container 300. A volume of the large container 100 is larger than that of the small container 300. The large container 100 includes a first opening 100*a* and a first bottom 100*b* positioned opposite to each other. After the machine cover is opened, the clothes are thrown into the large container 100 by using the first opening 100*a*. Inside the large container 100 is communicated with a drainage outlet by using a drainage valve. The drainage valve is controlled via electricity. In the washing process that closes the drainage valve, after finishing washing the drainage valve is opened to drain the water out of the large container 100.

Figure 4:
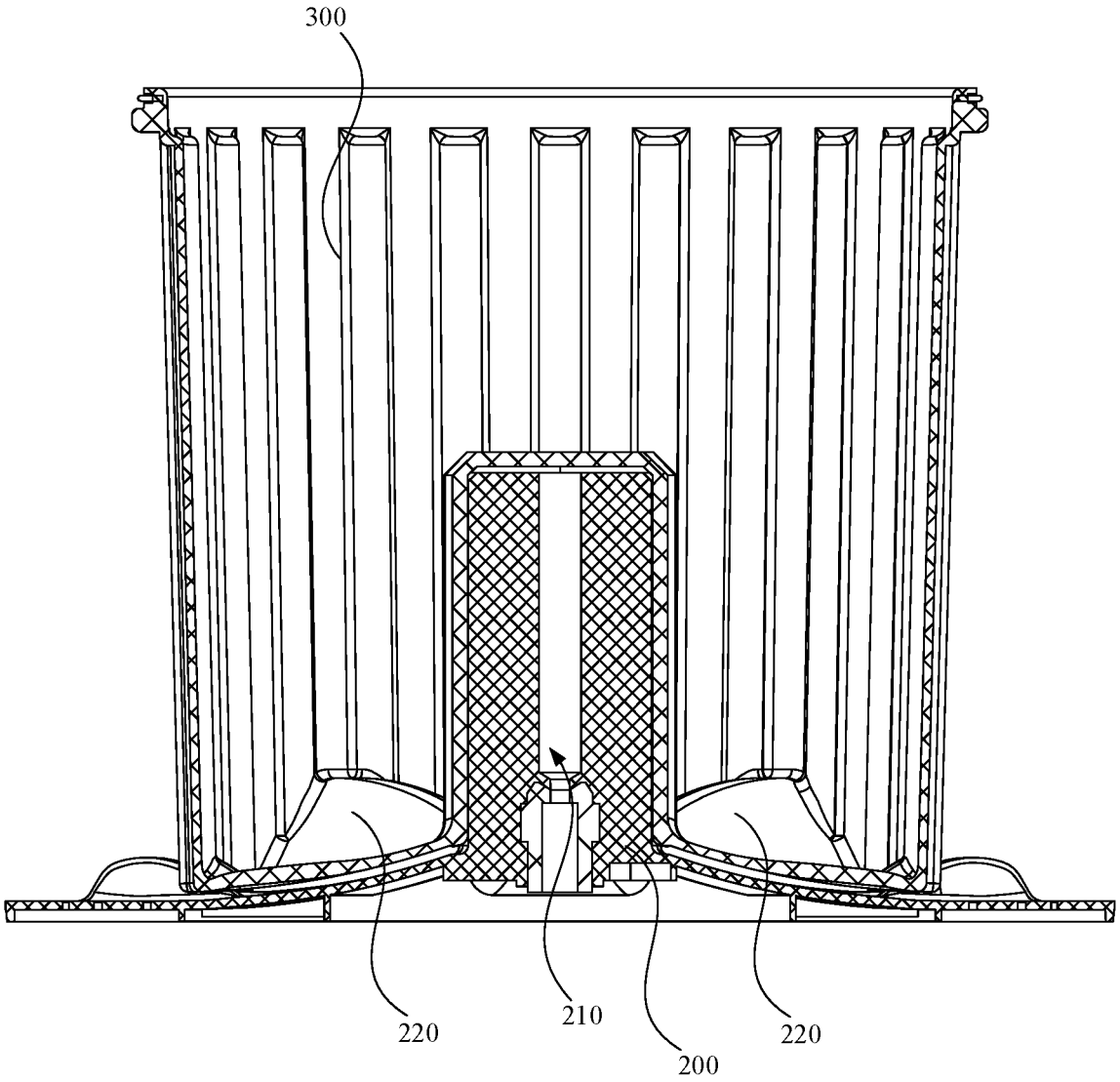
FIG. 4 is a sectional view of the wave wheel in FIG. 2.

With reference to FIG. 4, the wave wheel 200 is disposed on the first bottom 100*b*, and in particular disposed on the first bottom 100*b*. A side of the wave wheel 200, away from the first bottom 100*b* protrudes to form a positioning column 210. The section of the positioning column 210 is shaped as non-circular, ensuring an object fitted with the positioning column 210 to relatively slide with the positioning column 210.

More specifically, the positioning column 210 may be a spline, or a section of the positioning column 210 may be a regular polygon. If the positioning column 210 is a polygon column, an outer diameter of the positioning column 20 is further defined decreasing from the bottom to the top, such as in the embodiment that the section of the positioning column 210 is pentagon, that is, the positioning column 210 is a pentagon column. Not only can the small container 300 be assembled on the wave wheel 200, but also can provide power for the rotation of the small container 300. Of course, in other embodiments, the section of the positioning column 210 may be a regular triangle, a square or a hexagon etc.

A height of the positioning column 210 is greater than or equal to 70 mm, ensuring when the small container 300 is carried on the wave wheel 200, the small container 300 won't depart from the positioning column 210. For example, in the embodiment that the height of the positioning column 210 is determined as 120 mm so as not to cause a large eccentric of the small container 300 during rotation.

The positioning column 210 has a positioning hole 211, a fastener (not shown) is passing through the positioning column 210, which enables the wave wheel 200 to be positioned on the first bottom part 100*b* of the large container 100. More specifically, the positioning hole 211 may be a screw hole and the fastener is a nut bolt. When it is used, there is no need to disassemble the original washing machine complicatedly, it only needs to replace an original wave wheel with the wave wheel 200 in the embodiments of the present disclosure.

Figure 5:
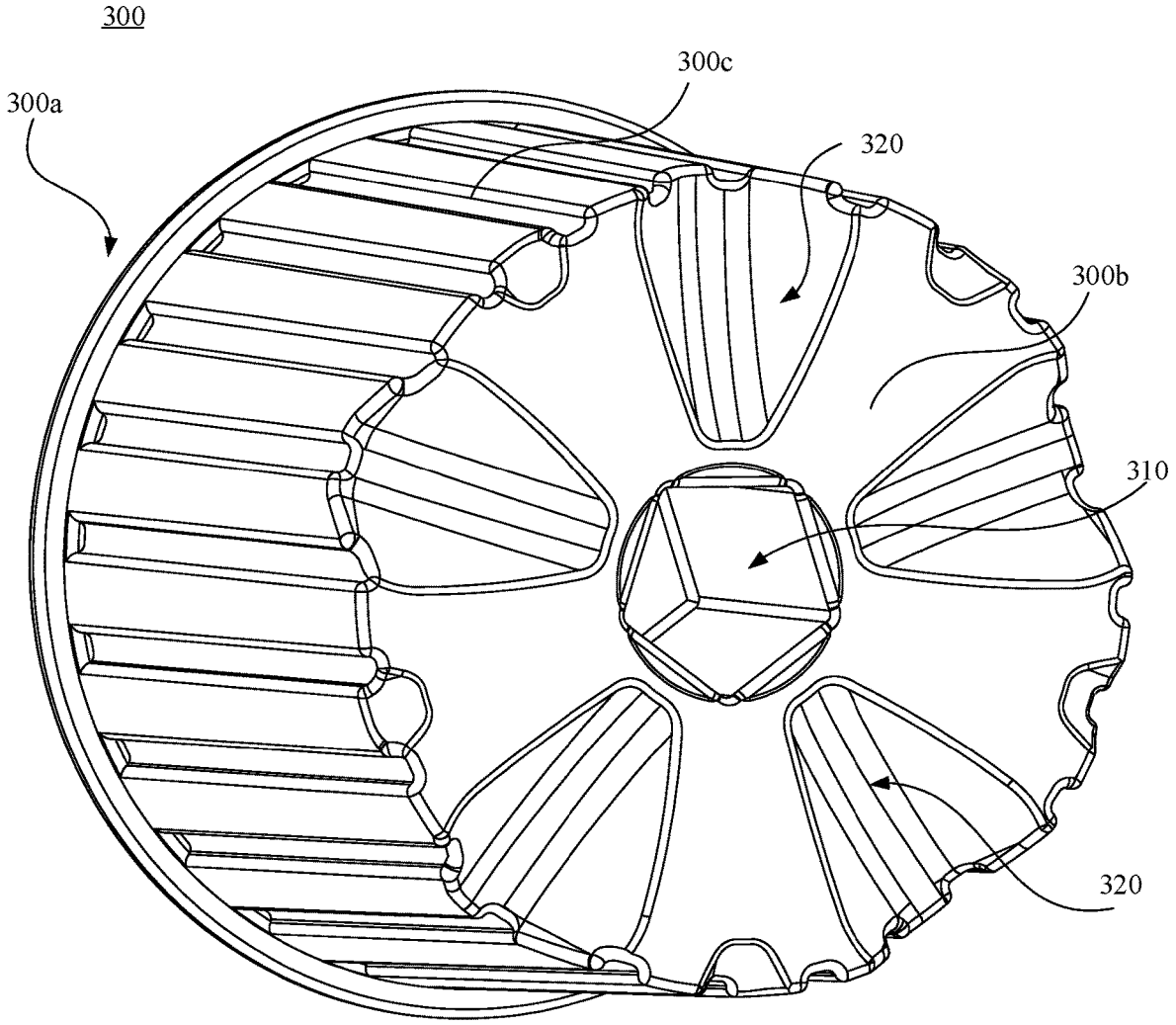
FIG. 5 is a perspective schematic view of the small container in FIG. 1.
Figure 6:
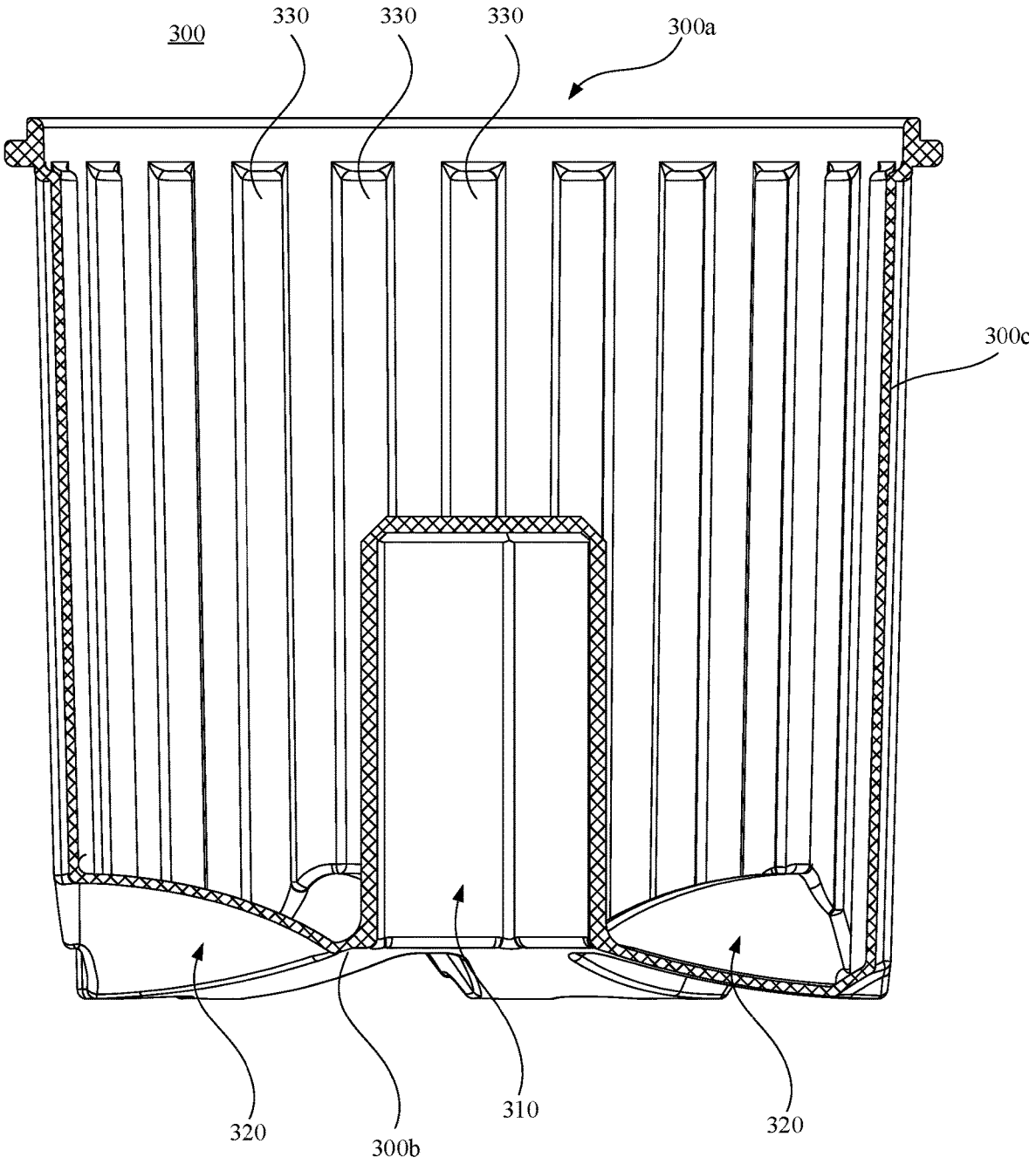
FIG. 6 is a sectional view of the small container in FIG. 1

With reference to FIG. 5 and FIG. 6, the small container 300 has a second opening end 300*a* and a second bottom part 300*b* corresponding with the second opening end 300*a*. The small container 300 may be detachably disposed in the large container 100. Therefore, when it needs to wash clothes needing special care, opening the machine cover, and assembling the small container 300 in the large container 100; the clothes needing special care may be thrown into the small container 300 for separate washing via a second opening end 300*a*. When it doesn't need to wash separately clothes needing special care, the small container 300 is detached from the large container 100. The height of the small container 300 is less than or equal to that of the large container 100.

The bevel 300*c* of the small container 300 tilts outwards, enabling the diameter of the small container 300 to be increasing along the direction from the second bottom 300*b* to the second opening 300*a*. More specifically, the bevel 300*c* of the small container 300 may tilt outwards 1.5° or bigger than 1.5°, but the bevel 300*c* of the small container 300 can't tilt outwards too much, avoiding the clothes in the small container 300 spun off during the rotation of the small container 300. Since the bevel 300*c* of the small container 300 is segregated from the bottom part 300*b* of the large container 100, water in the small container 300 can only be spun off from the second opening end 300*a* along the tilted bevel 300*c*, then the water flows into the large container 100, afterwards flowing out of the washing machine with the water in the large container 100. Of course, in other embodiments, the bevel 300*c* of the small container 300 is not tilted, but a one-way valve is given on the small container 300 to cause the water in the large container 100 can't flow into the small container 300, while the water in the small container 300 can flow into the large container 100 in the process of dehydration.

The second bottom part 300*b* concaves to form a recess 310 matched with a positioning column 210, making the positioning column 210 inserted into the recess 310. More specifically, the shape of the recess 310 is the same as the shape of the positioning column 210. After being assembled, the fitting between the bottom of the small container 300 and the wave wheel 200 is gapless.

Or after the second bottom part 300*b* of the small container 300 is assembled on the positioning column 210 of the wave wheel 200, an adequate gap is existed between the exterior of the positioning column 210 and the lateral of the recess 310, then an anti-slip mat (not shown) is set between the second bottom part 300*b* of the small container 300 and the wave wheel 200, strengthening a frictional force between the small container 300 and the wave wheel 200, thus the assembling reliability is improved to avoid the small container 300 being departed from the wave wheel 200 in the process of rotation.

More specifically, the anti-slip mat is an anti-slip rubber pad. When the small container 300 with the anti-slip rubber pad is disposed on the wave wheel 200, complete contact of the surfaces of the anti-slip mat and the wave wheel 200 ensures a certain extrusion pressure.

With reference to FIG. 2 and FIG. 4, a water string 220 is convexly positioned on a side of the wave wheel 200 that the side thereof faces with the first bottom part 100*b*. With reference to FIG. 5 and FIG. 6, a receiving groove 320 fitted with the water string 220 is concavely positioned on a side of the second bottom part that the side thereof faces with the wave wheel 200. The water string 220 radially extends along the radius of wave wheel 200, and the length of the water string 220 is larger or equal to the radius of the small container 300.

With reference to FIG. 2 and FIG. 6, the bevel 300*c* of the small container 300 includes convex ribs 330. The number of the convex ribs 330 is multiple, multiple convex ribs 330 are interval arranged along a periphery of the bevel 300*c* of the small container 300, each convex rib 330 extends along an axial direction of the bevel 300*c* of the small container 300, which may strengthen the container wall and the water string, and strengthen the frictional force with the clothes etc., also secure the clothes during dehydration to improve the dehydration effect.

In the embodiment that the small container 300 is assembled easily, if needed, the recess 310 of the small container 300 is set to align with the positioning column 210 of the wave wheel 200, then the small container 300 is disposed herein. In a process of disassembling, the small container 300 moves upward to depart from the recess 310 and the positioning column 210 successively.

Specifically, in other embodiments that the small container 300 may be integrated with the wave wheel 200, the bottom part 300*b* of the small container 300 is disposed on the wave wheel 200 and the wave wheel 200 is detachably disposed on the first bottom part 100*b* of the large container 100. For example, by means of a fastener such as a nut bolt or a method of slap-fit, the wave wheel 200 is detachably disposed on the first bottom part 100*b* of the large container 100. The diameter of the wave wheel 200 is bigger than the outer diameter of the small container 300. Detaching the wave wheel 200 from the large container 100 quickly, then the small container 300 and the wave wheel 200 integrated as one is assembled.

Specifically, in the embodiment that the small container 300 and the large container 100 are respectively given a dynamic structure and a washing procedure, thus when the small container 300 acts solely, in the original washing machine, the large container 100 may reach the aim of saving energy without rotation. Specifically, the washing machine includes a first dynamic structure, a first control device, a second dynamic structure and a second control device, the first control device controls the first dynamic structure to drive the large container rotating, the second control device controls the second dynamic structure to drive the small container 300 rotating. The first dynamic structure and the second dynamic structure may be independent with each other.

For instance, to realize rotation of the small container 300 is independent of the large container 100, the washing machine is powered by direct-drive mode, meanwhile, the washing procedure of the washing machine is designed. And a separated button is disposed thereon, after the user choses the washing procedure of the small container 300 by the button, of which the washing procedure is the same as an ordinal procedure. In a process of dehydration that the clutch and the large container 100 are not working, just the wave wheel 200 and the small container 300 assembled on the wave wheel 200 are driven by the washing shaft to rotate so as to reach the aim of dehydration. Consequently when the small container 300 is used to separately wash small pieces of clothes, the large container 100 is not working, therefore saving lots of electricity as well as reaching the aim of saving water and electricity.

Of course, in other embodiments that the small container 300 and the large container 100 may share one same dynamic structure and one same washing procedure, an aim that the small container 300 and the large container 100 are used to wash simultaneously may come true.

The above washing machine and washing drum 10 at least own following advantages:

In the present disclosure that an independent small container 300 disposed in the large container 100 may be fitted with the recess 310 by using the positioning column 210 or integrated with the wave wheel 200, and thus with the large container 100 which may form a container-in-container structure. In a washing process that the special clothes are disposed in the small container 300 while the water in the large container 100 fail to flow into the small container 300 during dehydration, the water in the small container 300 is spun off the bevel of the small container 300 into the large container 100, afterwards draining any water out of the large container 100, whereby separate washing of the clothes needing special care is realized. If no need to wash special clothes, just the small container is detached from the large container 100 and the positioning column 210 is assembled with the recess 310, which is convenient and quick.

Figure 7:
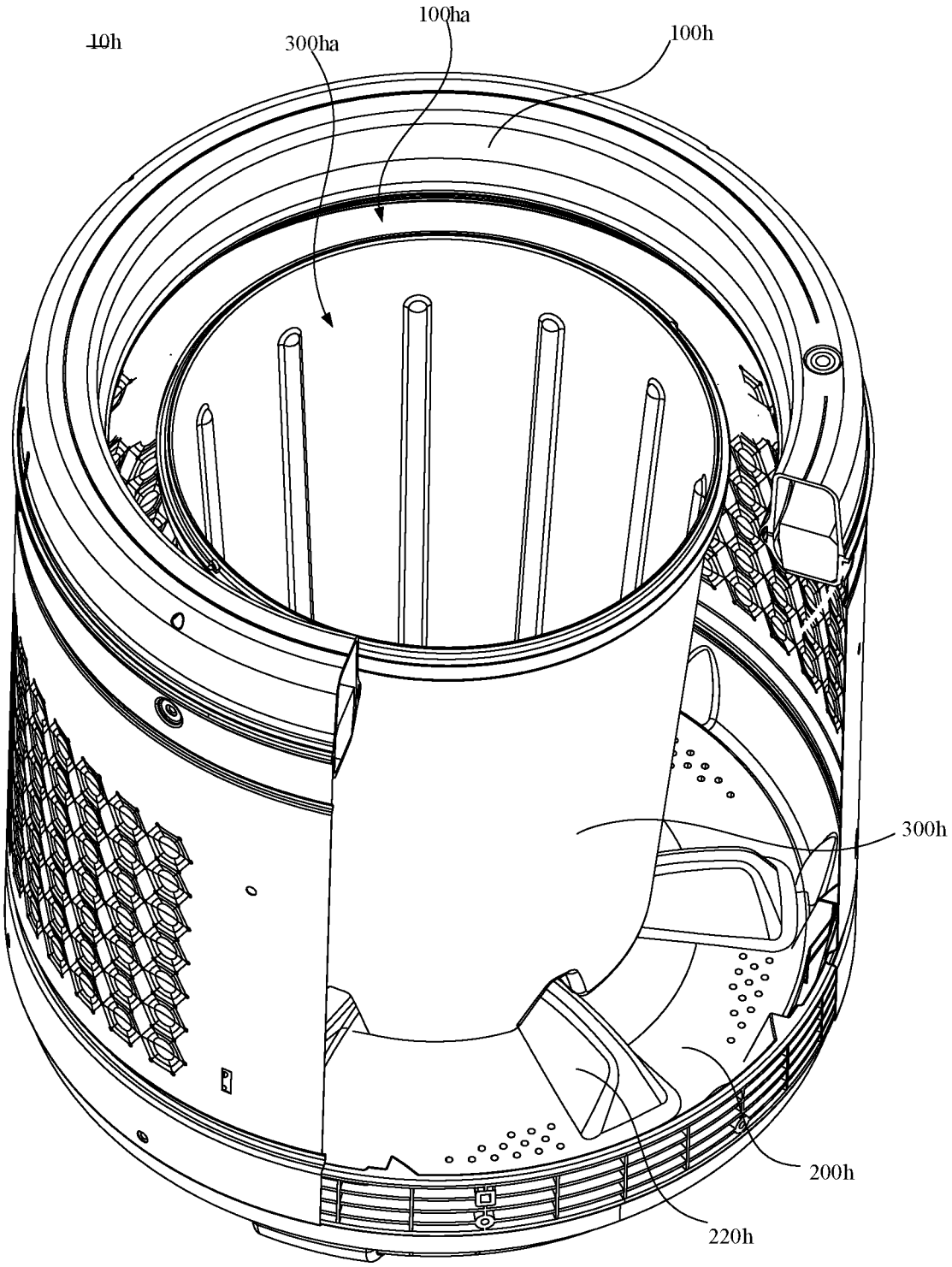
FIG. 7 is a structural diagram of the washing drum according to the second embodiment of the present disclosure.
Figure 8:
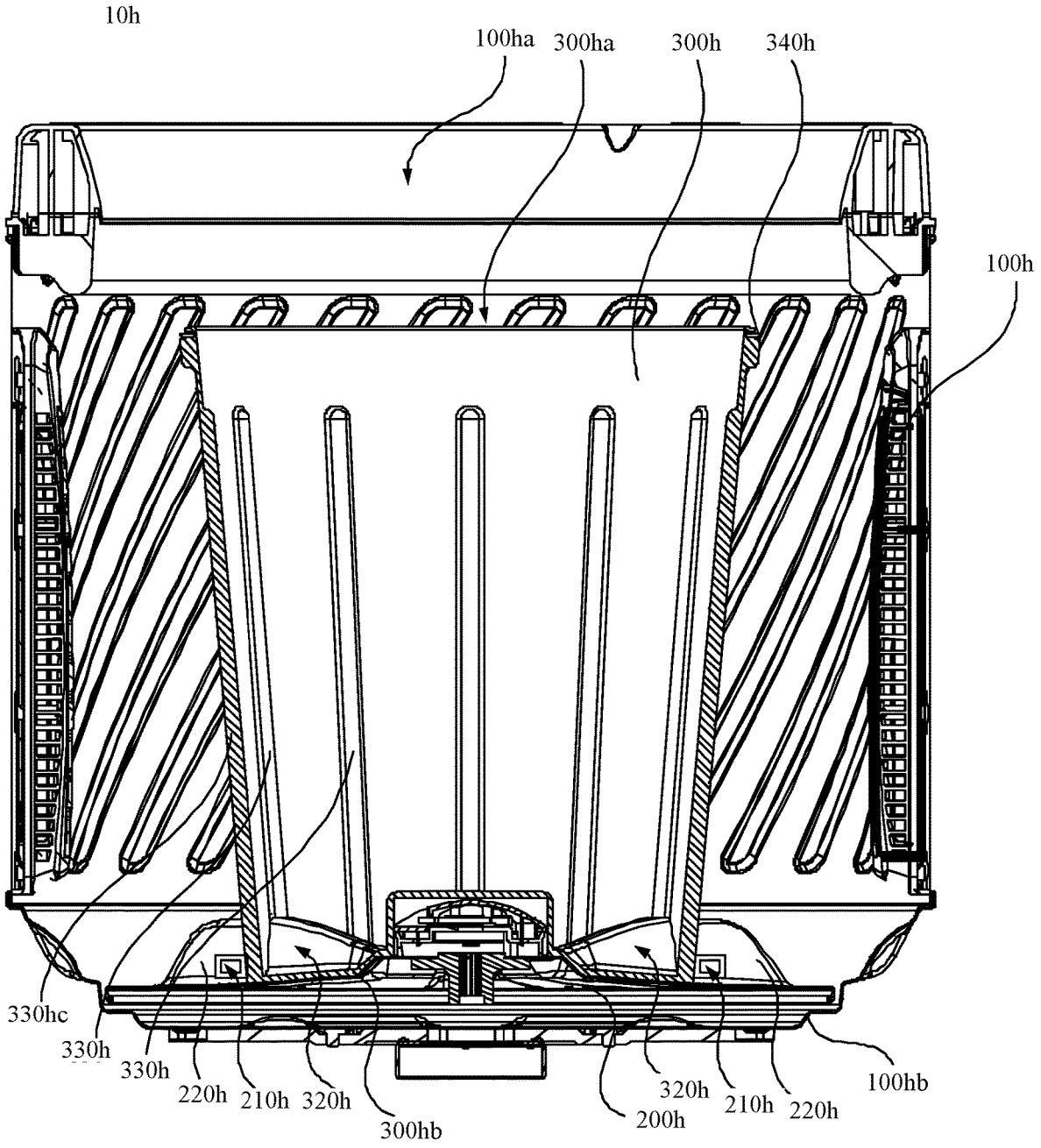
FIG. 8 is a sectional view of the washing drum in FIG. 7.

With reference to FIGS. 7 to 14 that are figures according to the second embodiment of the present disclosure, of which the washing machine includes a case of washing machine (not shown) and a washing drum 10*h*, as shown in FIGS. 7 and 8. The washing drum 10*h* may realize separate washing of the clothes needing special care, specifically taking the washing machine with a wave wheel as an example.

The washing drum 10*h* is disposed in the case of the washing machine, configured for accommodating the clothes needing washing, water and detergent etc. A machine cover that is pivoted is also disposed on the top of the case.

With reference to FIGS. 9 to 12, the washing drum 10*h* includes a large container 100*h*, a wave wheel 200*h*, a small container 300 and a hinge mechanism 400. The volume of the large container 100*h* is larger than the small container 300*h*. The large container 100*h* has a first opening end 100*ha* and a first bottom part 100*hb* opposite with each other. After opening the machine cover, the clothes are thrown into the large container 100*h* via the first opening end 100*ha*. The inside of the large container 100*h* is communicated with the drainage pipe via a drainage valve that is controlled by electronic control method. In the washing process that the drainage valve is closed, then the drainage valve is opened after finishing washing, meanwhile the water in the large container 100*h* is drained out.

Figure 13:
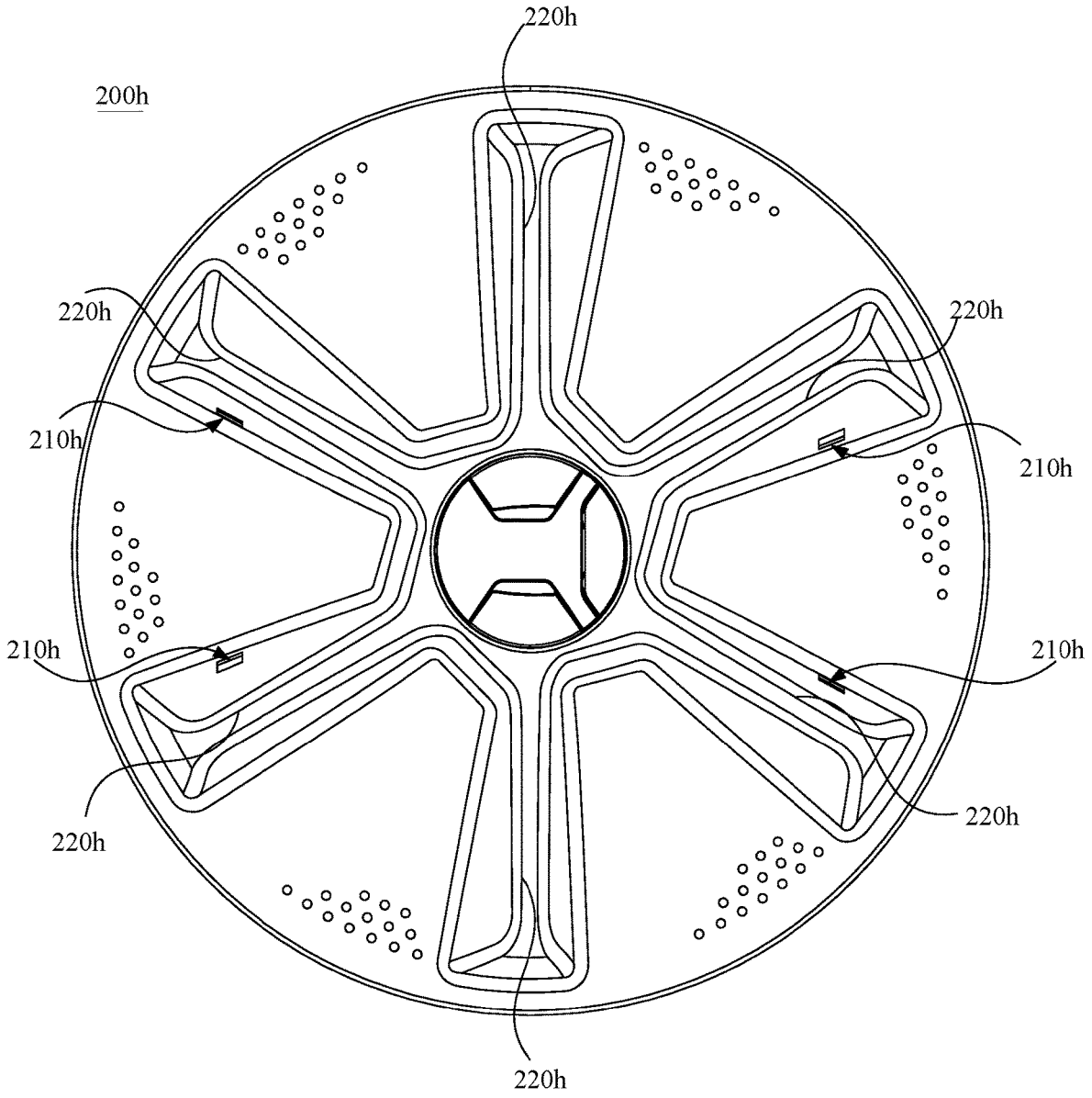
FIG. 13 is a structural diagram of the wave wheel in FIG. 9.

With reference to FIG. 13, the wave wheel 200*h* is disposed on the first bottom part 100*hb*, in particular, inside the first bottom part 100*hb*. The wave wheel 200*h* has mounting holes 210, the number of the mounting holes 210*h* is four according to embodiments of the present disclosure. Two of the mounting holes 210 are set opposite to the other two of that.

Figure 11:
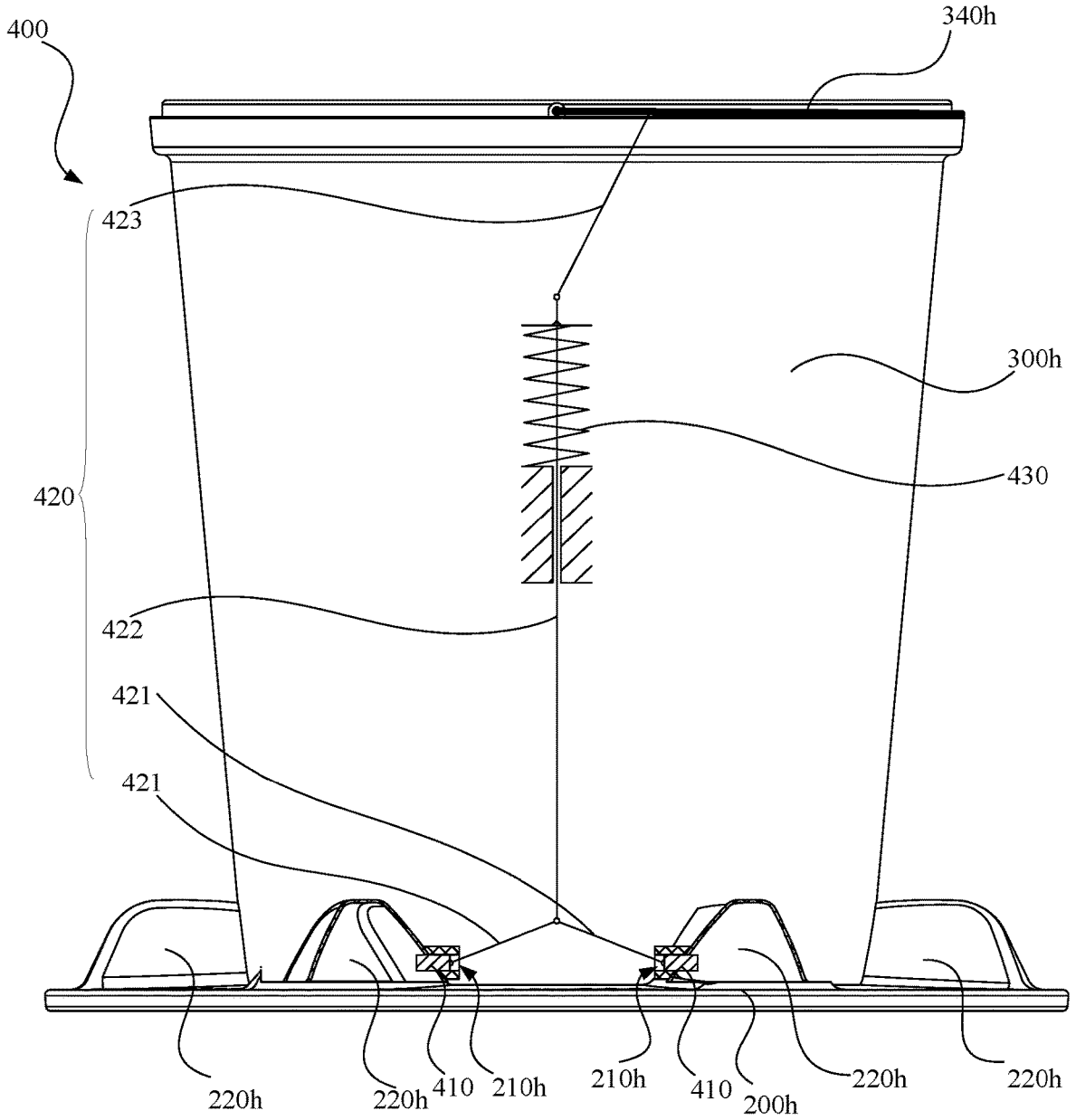
FIG. 11 is a side view of the small container and the wave wheel in FIG. 7.
Figure 12:
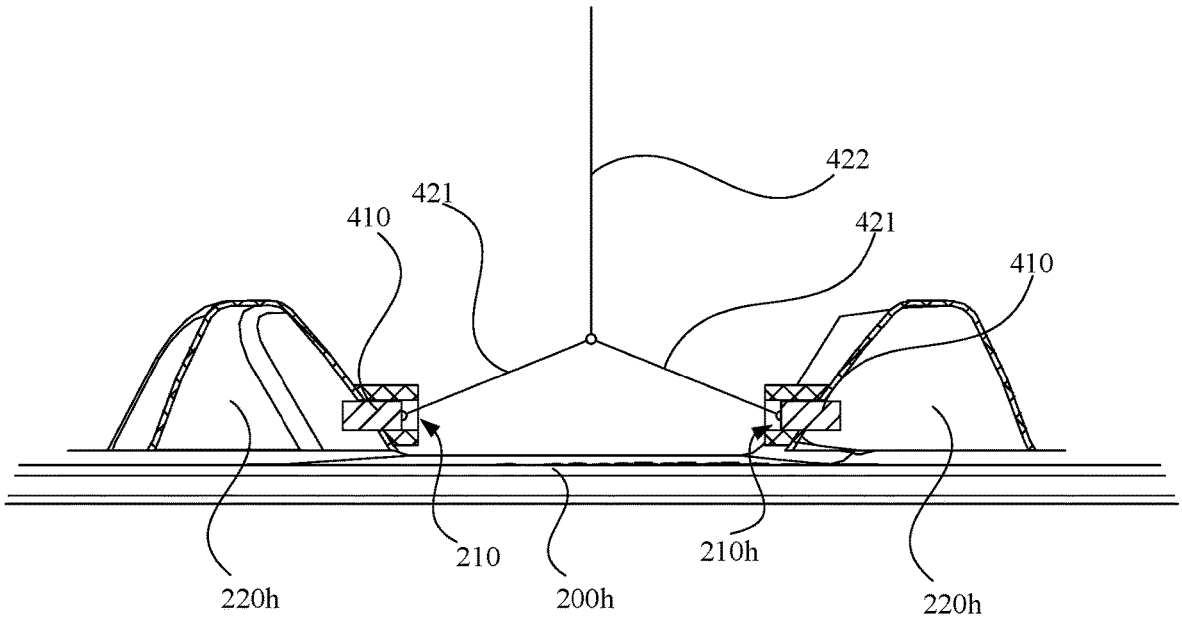
FIG. 12 is a partial schematic view of FIG. 11.

A side of the wave wheel 200*h* that the side thereof is away from the first bottom part 100*hb* protrudes to form a water string 220*h* with a certain height. With reference to FIG. 11 and FIG. 12, a receiving groove 320*h* fitted with the water string 220*h* is concavely formed on a side of the second bottom part 300*hb* that the side thereof faces with the wave wheel 200*h*. The water string 220*h* is radially extending along the wave wheel 200*h*, a length of the water string 220*h* is longer or equal to a diameter of the small container 300*h*. According to embodiments of the present disclosure, the mounting holes 210*h* are opened on a lateral surface of the water string 220*h*.

Figure 9:
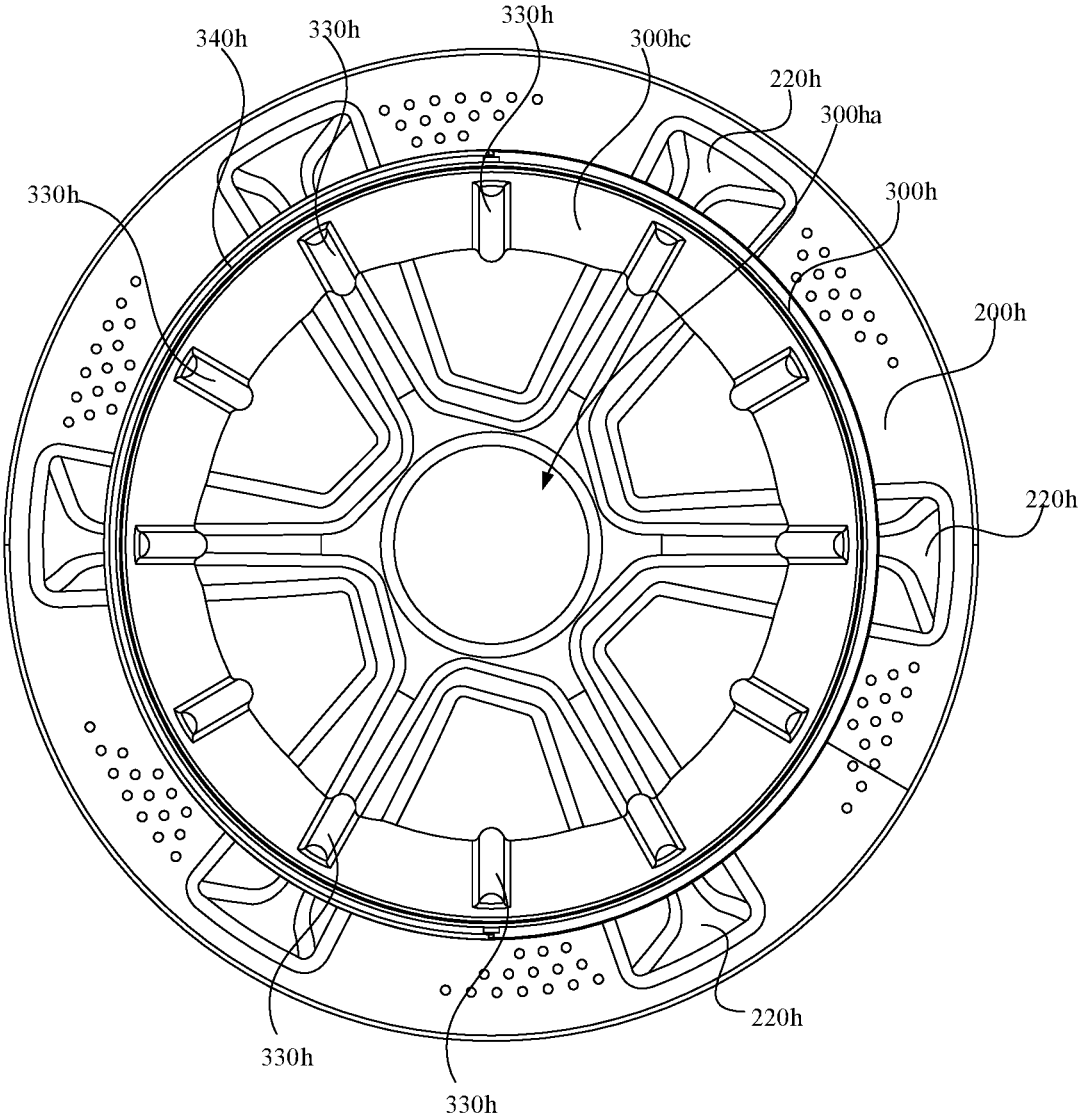
FIG. 9 is a top view of the small container and the wave wheel in FIG. 7.
Figure 10:
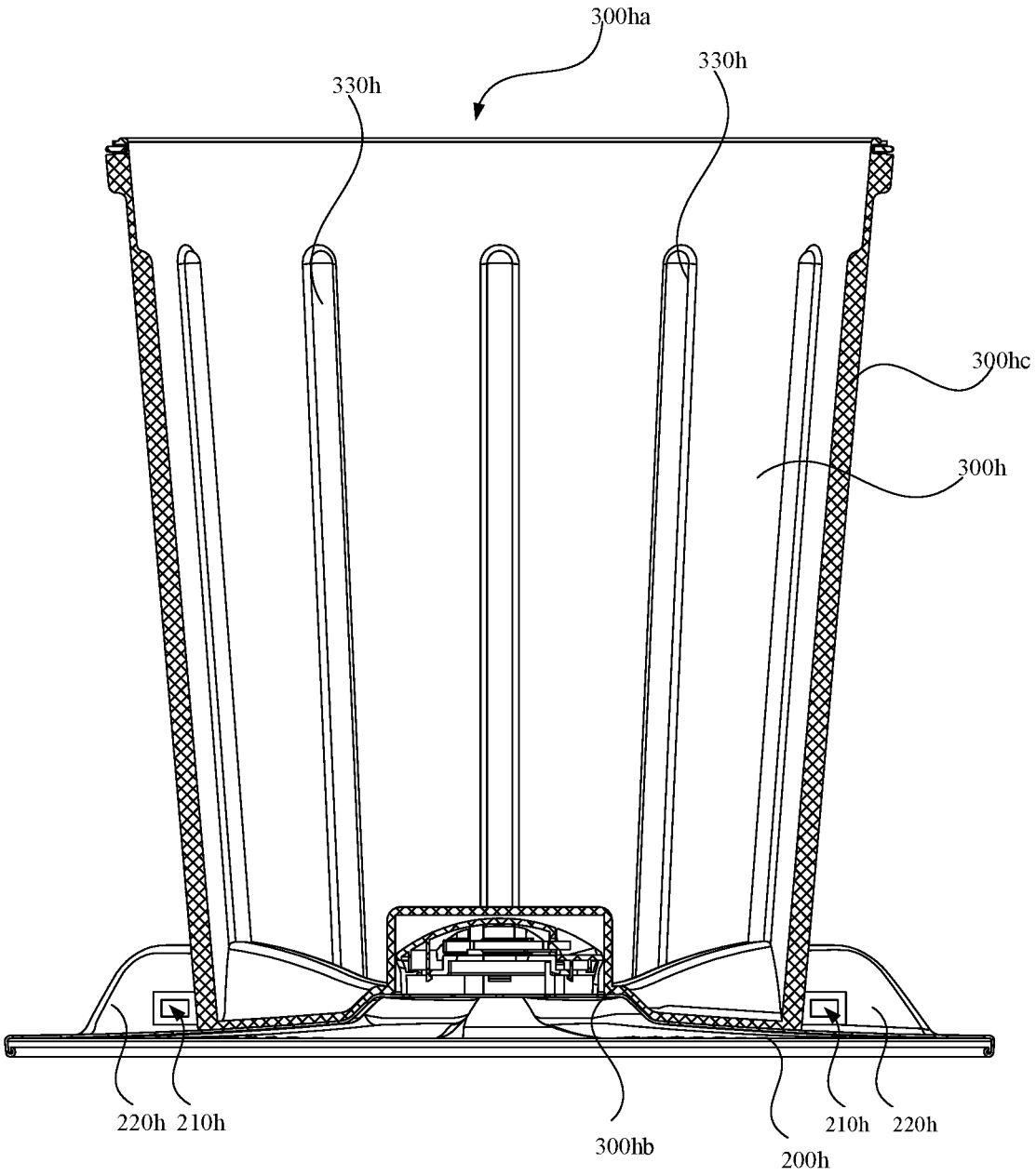
FIG. 10 is a sectional view of the small container and the wave wheel in FIG. 7.

With reference to FIGS. 8 to 10, the small container 300*h* has a second opening end 300*ha* and a second bottom part 300*hb* opposite with each other, the second bottom part 300*hb* is disposed on the wave wheel 200*h*. The small container 300*h* is detachably disposed in the large container 100*h*, therefore, when it needs to separate washing of clothes needing special care, the small container 300*h* is assembled in the large container 100*h* by opening the machine cover, and the special clothes are thrown into the small container via the second opening end 300*ha* for separate washing. When it doesn't need to separate washing of clothes needing special care, the small container 300*h* is detached from the large container 100*h*. The height of the small container 300*h* is less than or equal to the height of the large container 100*h*.

With reference to FIG. 10, the bevel 300*hc* of the small container 300*h* tilts outwards, thus the diameter of the small container 300*h* is increasing from the second bottom part 300*hb* to the second opening end 300*ha*. More specifically, the bevel 300*hc* of the small container 300*h* may tilt 1.5° or more than 1.5°, but can't tilt too much so as not to throw out the clothes in the small container 300*h* during rotation. Since the bevel 300*hc* of the small container 300*h* and the second bottom part 300*hb* are separated from the large container 100*h*, thus the water in the small container 300*h* can be thrown out of the second opening end 300*ha* along the tilted bevel 300*hc*, flowed into the large container 100*h*, next with the water in the large container 100*h* flowed out of the washing machine. Of course, in other embodiment, the bevel of the small container may not tilt, but by using a one-way valve carried on the bevel of the small container, the water in the large container can't flow into the small container while the water in the small container may flow into the large container during dehydration.

With reference to FIG. 9, the second opening end 300*ha* of the small container 300*h* has a pull ring 340*h* that is pivoted. By lifting the pull ring 340*h*, the small container 300*h* is detached from the large container 100*h*. The biggest outer diameter of the small container 300*h* is less than or equal to 300 mm.

With reference to FIG. 8, the receiving groove 320*h* fitted with the water string 220*h* is concavely formed on a side of the second bottom part 300*hb* that the side thereof faces with the wave wheel 200*h*. The water string 220*h* is radially extending along the wave wheel 200*h*, a length of the water string 220*h* is longer or equal to a diameter of the small container 300*h*.

The bevel 300*hc* of the small container 300*h* includes convex ribs 330*h*. The number of the convex ribs 330*h* is multiple, multiple convex ribs 330*h* are interval arranged on a periphery of the bevel 300*hc* of the small container 300*h*. Each convex rib 330*h* extends along an axial direction of the bevel 300*hc* of the small container 300*h*, so as to strengthen the container wall and the water string, to increase the frictional forces between the container wall, the water string with the clothes, also to fix the clothes during dehydration, with consequently contributing to dehydration effect.

An anti-slip mat (not shown) is disposed between external of the second bottom part 300*hb* of the small container 300*h* and the wave wheel 200*h*, for enhancing the frictional force between the small container 300*h* and the wave wheel 200*h*, further enhancing reliability of assembling, so as not to cause the detaching of the small container 300*h* from the wave wheel 200*h* during rotation.

More specifically, the anti-slip mat is an anti-slip rubber mat. After the small container 300*h* having the anti-slip rubber mat is disposed on the wave wheel 200*h*, the anti-slip rubber mat and the wave wheel 200*h* are completely contacted to ensure a certain pressure. Between the small container 300*h* and the wave wheel 200*h* has a gap for avoiding, if the small container 300*h* contacts the wave wheel 200*h* beforehand, in a case infirmness of the contact when the anti-slip rubber mat is pressed to deform.

Figure 14:
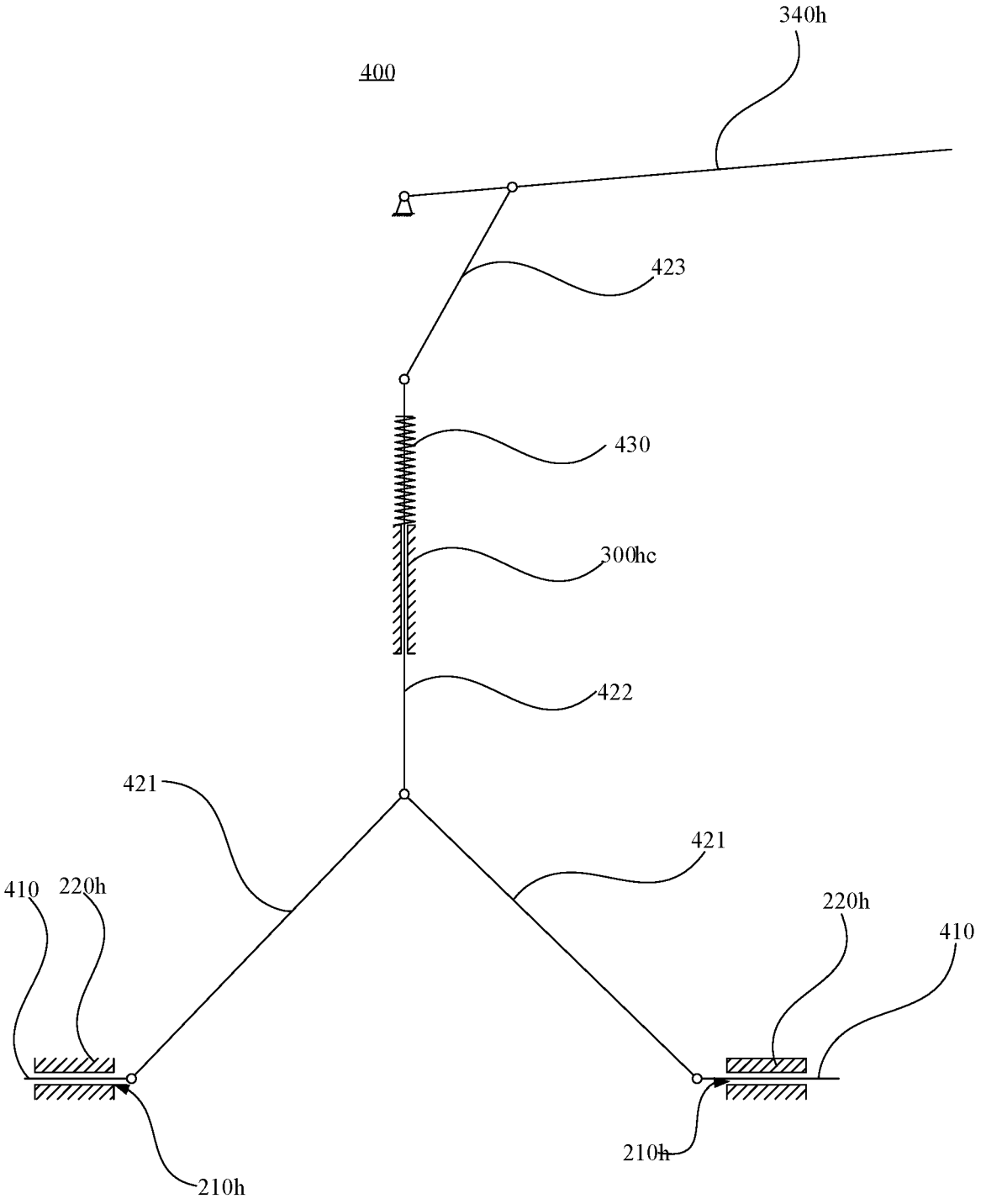
FIG. 14 is a schematic diagram of the hinge mechanism in FIG. 11.

With reference to FIG. 14, the hinge mechanism 400 includes a slide block 410, a connecting rod 420 and a spring 430, the slide block 410 may be disposed in the mounting holes 210*h*, one end of the connecting rod 420 is hinged with the slide block 410, the other end of the connecting rod 420 is connected with the pull ring 340*h*, one end of the spring 430 is fixed with the lateral wall of the small container 300*h*, the other end is connected with the connecting rod 42.

More specifically, the number of the hinge mechanisms 400 is two, two hinge mechanisms 400 are respectively disposed at two sides of the pull ring 340*h*, it is selectable to respectively dispose the two mechanisms 400 at two different sides of the small container 300*h* in the radial direction. The number of the slide blocks 410 of each hinge mechanism 400 is two, two slide blocks 410 are respectively disposed in the mounting holes 210*h*.

The connecting rod 420 includes a first connecting rod 421, a second connecting rod 422 and a third connecting rod 423, each slide block 410 is hinged with one end of the first connecting rod 421. Therefore, the number of the first connecting rods 421 is four, each slide block 410 is corresponding with a first connecting rod 421. The other end of the first connecting rod 421 is hinged with one end of the second connecting rod 422, that is, one end of the second connecting rod 422 has two first connecting rods 421. The other end of the second connecting rod 422 is hinged with one end of the third connecting rod 423, the other end of the third connecting rod 423 is connected with the pull ring 340, one end of the spring 430 is connected with the third connecting rod 423, the other end is fixed with the lateral wall 300*hc* of the small container 300*h*.

When the user lifts pull ring 340*h* to lift the small container 300*h*, the pull ring 340*h* drives the third connecting rod 423 to move upwards, when the second connecting rod 422 moves upwards, the spring 430 is stretched thus the first connecting rod 421 moves upwards too, so as to drive two opposite slide blocks 410 to move closer with each other, and hence the slide blocks 410 departs from the mounting hole 210*h*. On the contrary, when the small container 300*h* is disposed on the wave wheel 200*h*, the pull ring 340*h* is drop back due to the action of the spring 430. Because of the gravity and the spring force, the third connecting rod 423, the second connecting rod 422 and the first connecting rod 421 move downwards, thus ensuring the two slide blocks 410 to move departing from each other until move into corresponding mounting holes 210*h*, which reaches a purpose of fixing.

More specifically, in the embodiment, each of the small container 300*h* and the large container 100*h* has an independent dynamic structure and a washing procedure, therefore when the small container 300*h* is in a sole operation, the large container 100*h* doesn't need to operate, which reaches a purpose of saving energy. More specifically, the washing machine includes a first dynamic mechanism, a first control device, a second dynamic mechanism and a second control device. The first control device controls the first dynamic mechanism to drive the rotation of the large container 100*h*, the second control device controls the second dynamic mechanism to drive the rotation of the small container 300*h*. The first dynamic mechanism and the second dynamic mechanism are independent with each other.

For example, to realize the rotation of the small container 300*h* is independent with the large container 100*h*, the washing machine adopts a direct driving system. Moreover, by means of designing the washing procedure of the washing machine, a sole button is added, whereby users may choose the small container 300*h* to wash. The washing procedure of the washing machine is the same as an ordinal procedure, during dehydration the clutch is not working while the large container 100*h* is not working, only the washing shaft drives the wave wheel 200*h* and the small container 100*h* mounted on the wave wheel 200*h* to rotate in high speed to realize the purpose of dehydration. In that case, when the small container 300*h* is solely washing small pieces of clothes, the large container 100*h* doesn't work, which saves a great amount of electricity as well as reaches the purposes of saving water and electricity.

Of course, in other embodiments that the small container 300*h* and the large container 100*h* share one same dynamic structure and control device, so as to realize the purpose that the small container 300*h* and the large container 100*h* wash simultaneously.

The aforementioned washing machine and the washing drum thereof own at least following characters:

By means of a sole small container 300*h* disposed in the large container 100*h*, the small container 300*h* may be detachably disposed in the large container 100*h* by using a hinge mechanism 400, so as to form a container-in-container structure. In the process of washing, the clothes needing special care are disposed in the small container 300*h*, the water in the large container 100*h* can't flow into the small container 300*h*, and the water in the small container 300*h* may be thrown into the large container 100*h* along the tilted bevel 300*hc* of the small container 300*h* during dehydration, which realize the purpose of separate washing of clothes needing special care. When users lift the pull ring 340*h* to lift the small container 300*h*, the pull ring 340*h* drives the connecting rod 420 to move upwards, so as to drive the slide block 410 to move until departing from the mounting holes 210*h*. On the contrary, when the small container 300*h* is disposed on the wave wheel 200*h*, the pull ring 340*h* is drop back due to the action of the spring 430. Because of the gravity and the spring force, the connecting rod 421 move downwards, thus the slide blocks 410 move into the mounting holes 210*h* on the wave wheel 200*h*, which reaches a purpose of fixing.

Figure 15:
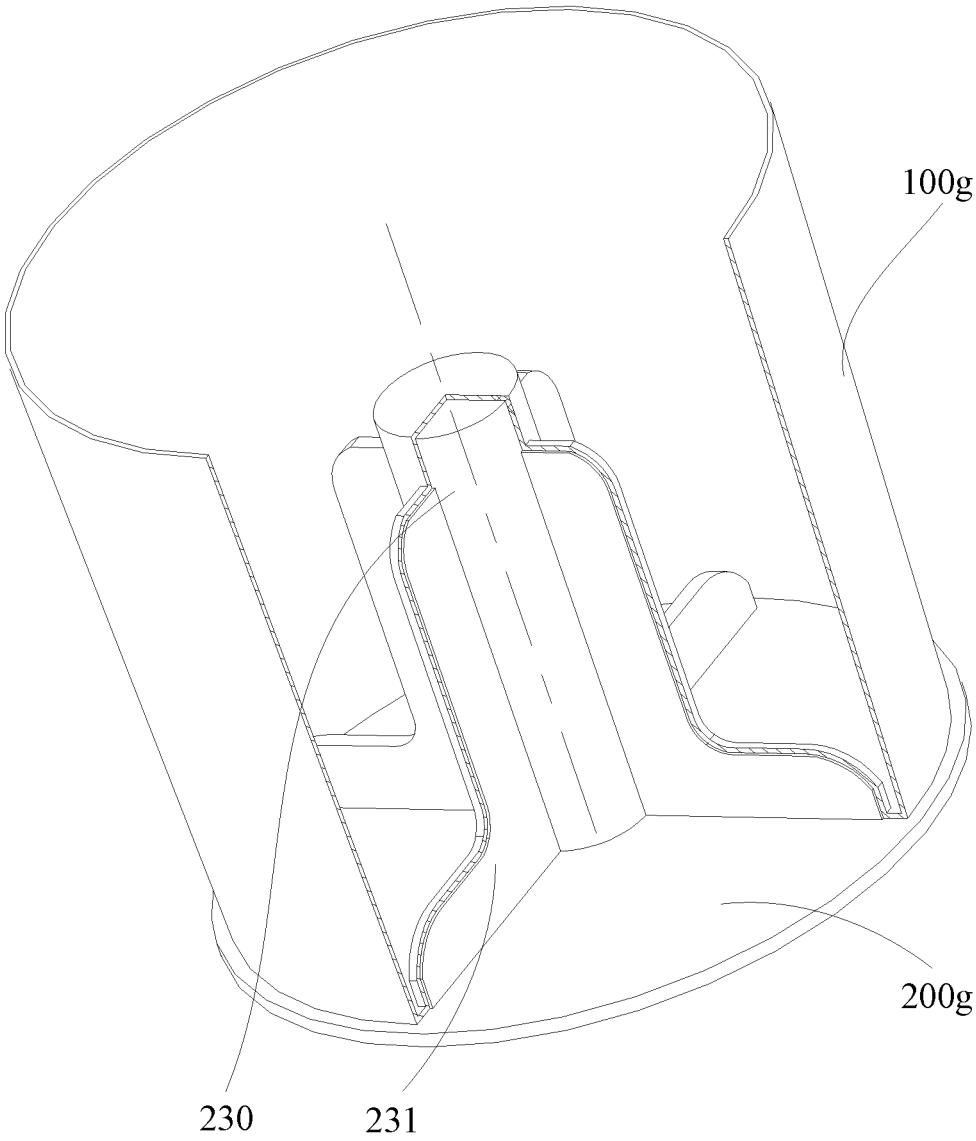
FIG. 15 is a structural diagram of the large small container according to the third embodiment of the present disclosure.

With reference to FIG. 15 that is a structural diagram of the small container 100*g* according to the third embodiment of the present disclosure, of which, the small container 100*g* is disposed in the large container (not shown). The large container has a first opening end (not shown) and a first bottom part (not shown) opposite with each other. The washing drum further includes a wave wheel 200*g* set on the first bottom part. A mixing column 230 is convexly set on a side of the wave wheel 200*g* that the side thereof faces away from the first bottom part. Multiple leaves 231 are concavely set on a periphery wall of the mixing column 230. The small container 100*g* has a second opening end and a second bottom part positioned opposite to each other; the second bottom part, near to the second opening end, has a groove fitted with the mixing column 230 and card slots fitted with the leaves 231. Therefore, the mixing column 230 and the leaves 231 are inserted into the corresponding groove and card slots. And the mixing column 230 is inserted into the groove so as to position the small container 100*g*, further, the leaves 231 are inserted in the cart slots so as not to cause the small container 100*g* deviating from the wave wheel 200*g*. In a process that the small container 100*g* is solely used to wash, the small container 100*g* is sleeved on the mixing column 230 by using the groove, the small container 100*g* rotates along the rotation of the wave wheel 200*g*, to washing clothes in the small container 100*g*. In a process that the small container 100*g* is not used to wash, the groove of the small container 100*g* is departed from the mixing column 230, and hence the small container 100*g* is taken out, in that case, the large container and the wave wheel 200*g* are working to wash clothes, the mixing column 230 mixes the clothes and water in the large container, enlarging the mixing strength to the clothes may produce a better cleaning effect. In the embodiment, the mixing column 230 may be circular or non-circular.

In the embodiment, each leave 231 is evenly disposed on a periphery wall of the mixing column 230, which ensures the strength of the mixing column 230 is evenly distributed so as to mix more evenly. Moreover, in the embodiment, an end of the leave 231 that nears to the wave wheel 200*g* is integrally connected with the wave wheel, extending outwards along an axis of the wave wheel. Therefore, the stress of the leaves 231 is increased as well as the mixing area of the leaves 231 is increased, improving the cleaning effect.

Figure 16:
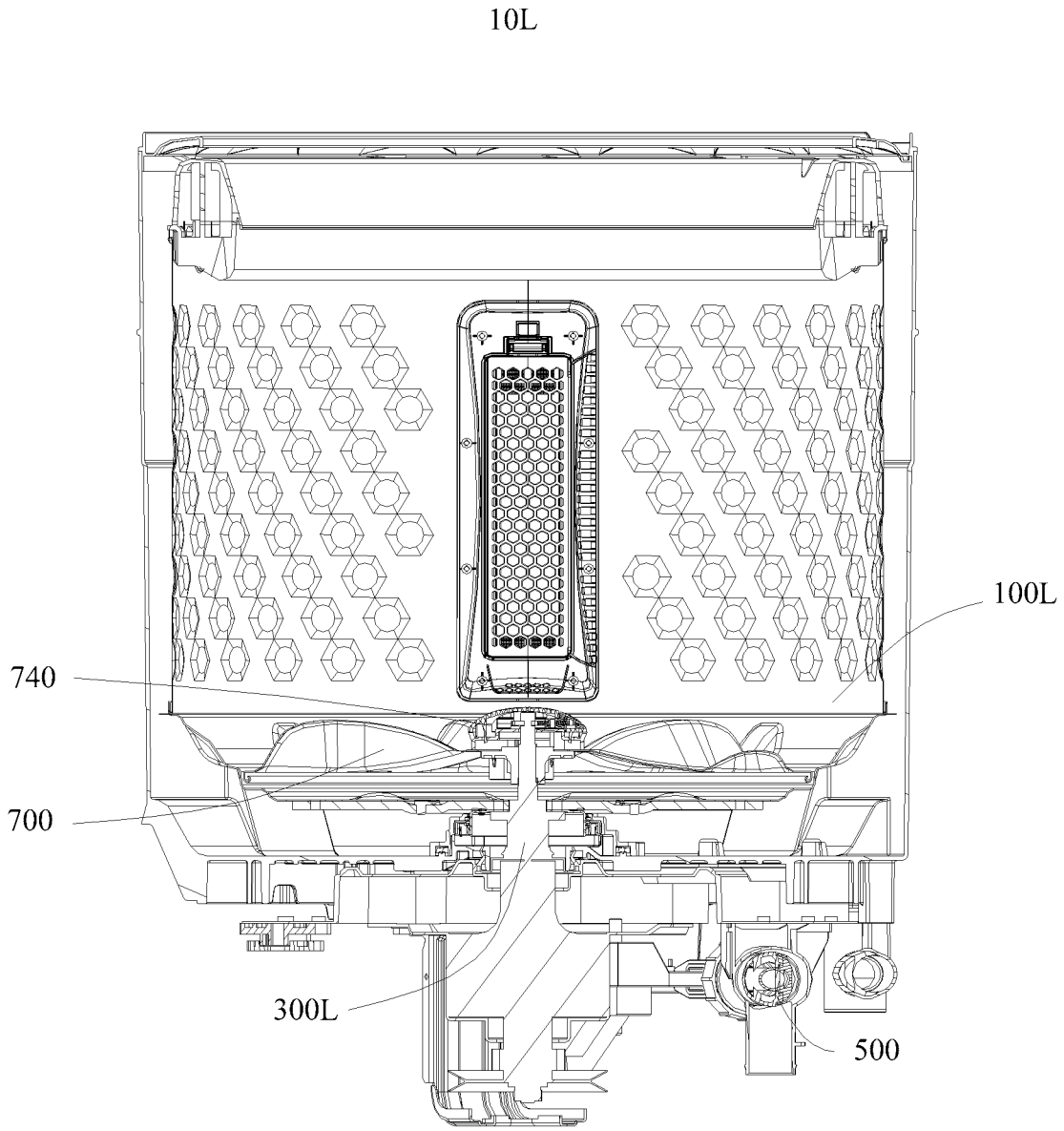
FIG. 16 is an internal structural diagram of the washing machine according to the fourth embodiment of the present disclosure.
Figure 17:
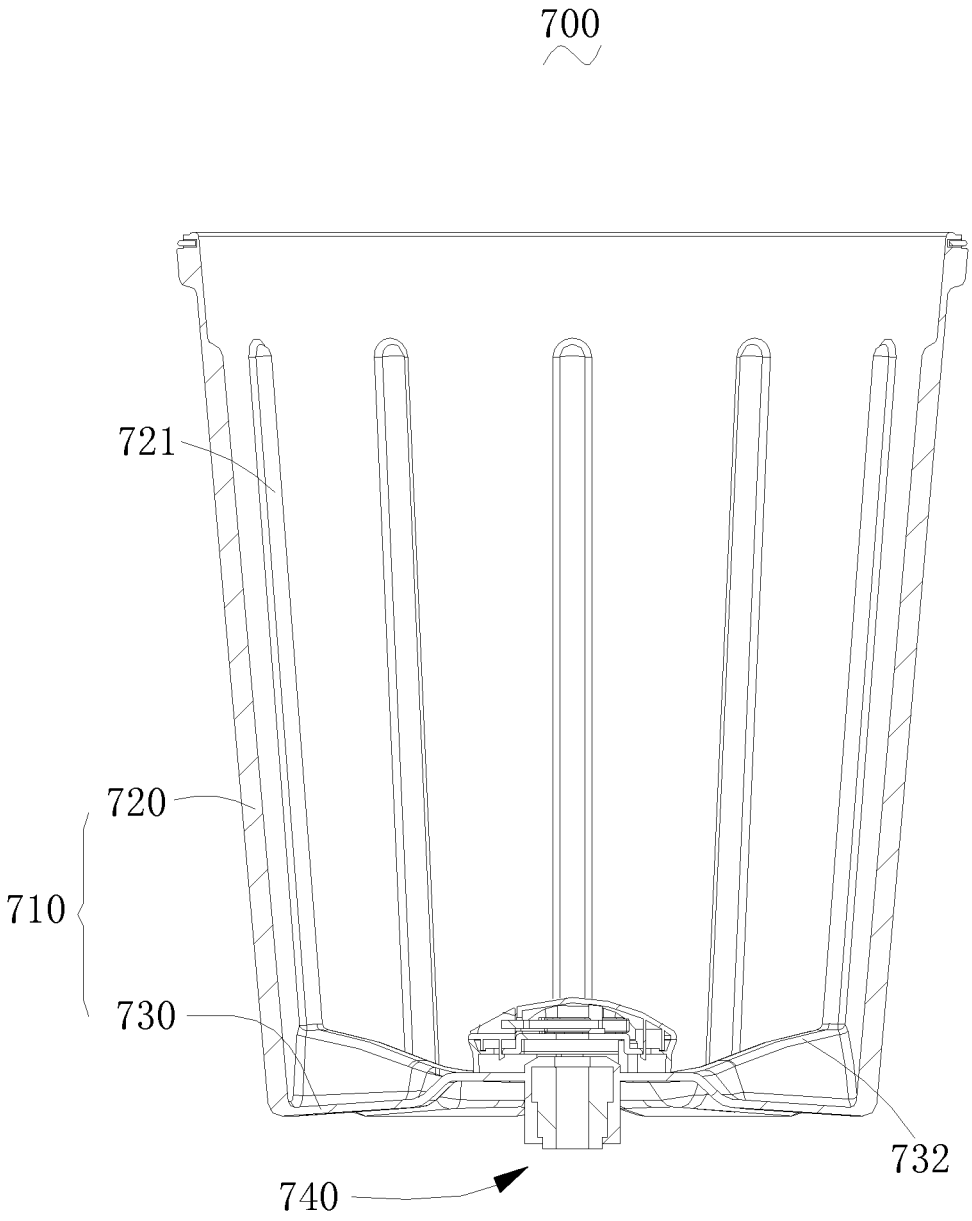
FIG. 17 is an internal structural diagram of the small container according to the fourth embodiment of the present disclosure.

With reference to FIGS. 16 and 17 that are the washing machine 10L according to the fourth embodiment of the present disclosure. The washing machine 10L includes a drive shaft 300L, a drive motor 500 and a washing drum 11. The washing drum 11 includes a large container 100L and a small container 700. The small container 700 is detachably disposed in the large container 100L. An opening of the small container and an opening of the large container are positioned opposite to each other. Between an external wall of the small container 700 and an internal wall of the large container 100L has a gap. The drive shaft 300L is connected with the drive motor 500. The small container 700 is coaxially disposed in the large container 100L, with reference to FIGS. 17 and 18. The small container 700 includes a container body 710 and a first locking mechanism 740, the container body 710 includes a container wall 720 and a container bottom 730 connected with each other integrally. Multiple first ribs 721 are convexly positioned inside the container wall 720, multiple second ribs 732 are convexly positioned inside the container bottom 730. The first locking mechanism 740 is positioned at the middle of the container bottom 730. With reference to FIGS. 16 and 17, the first locking mechanism 740 is detachably locked with the drive shaft 300L, such as, when washing clothes with a small volume or quantity, to save water and electricity, the first locking mechanism 740 may lock the small container 700 on the drive shaft 300L to separate the interior of the container body 710 from the exterior. The clothes can be set in the container body 710, stirring the water in the container body 710 by means of the second ribs 732 arranged on the container bottom 730, rubbing and washing the clothes by means of the first ribs 721 arranged on the container wall 720, which realizes the purpose of separate washing clothes. Meanwhile, since the volume of the small container 700 is small, in the washing process, it saves water and electricity more with a better cleaning effect.

Figure 18:
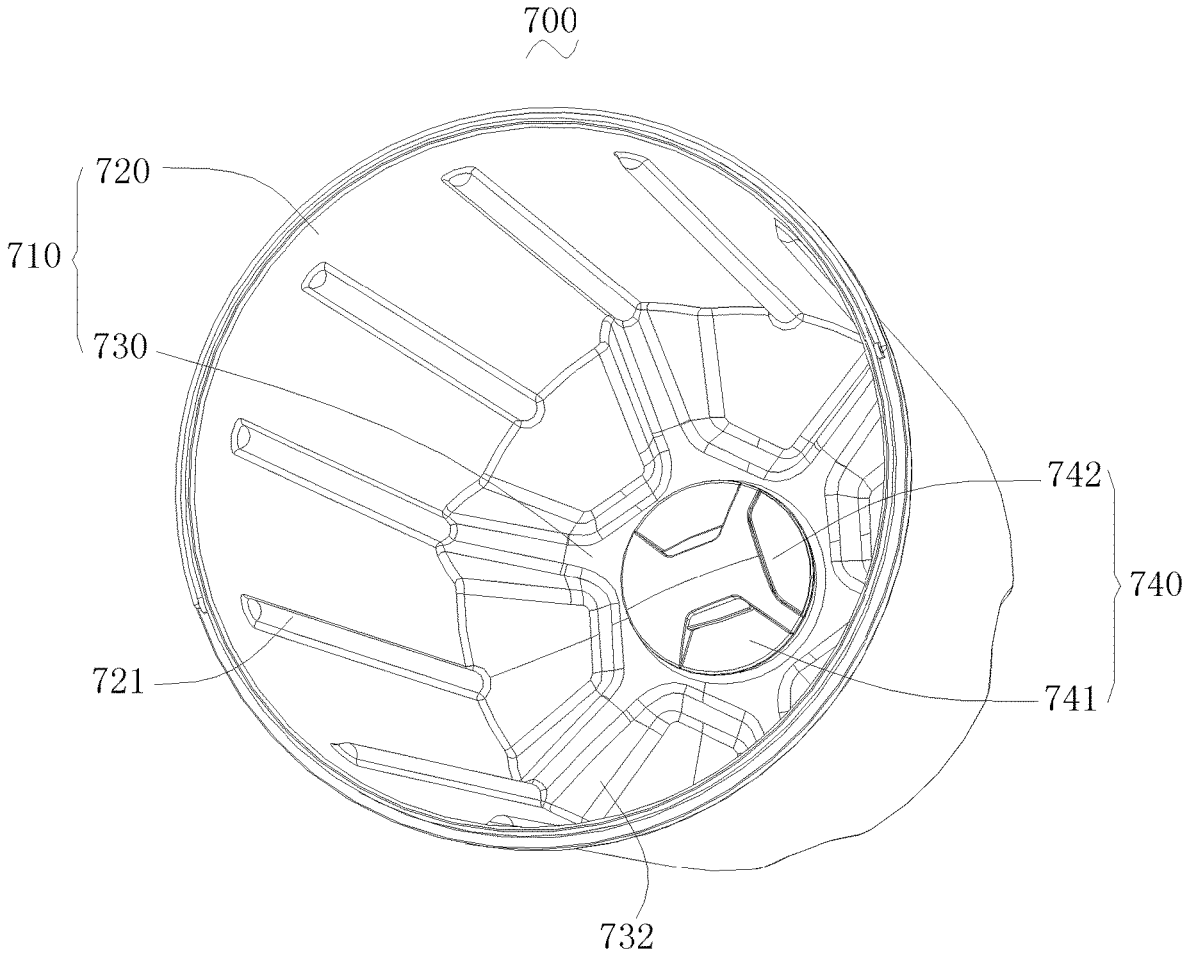
FIG. 18 is a stereoscopic structural diagram of the small container according to the fourth embodiment of the present disclosure.

To cause the rotation of the container body 710 more smoothly, such as, as shown in FIG. 18, the section of the container wall 720 is shaped as annular. For instance, the section of the container wall 720 is annular in a horizontal direction. For instance, the container wall 720 is a cylinder with a hollow central section. Therefore, the container body 710 rotates more smoothly with the rotation of the drive shaft 300L.

To cause the clothes can be more easily disposed in the container body 710 and get a better cleaning effect, for instance, as shown in FIG. 17, the diameter of the container wall 720 is gradually decreasing from an end thereof away from the container bottom 730, to the other end thereof near to the container bottom 730. For instance, the diameter of the opening of the container body 710 is bigger than that of the bottom part of the container body 710, in a case the clothes can be easily disposed in the container body 710. And the small diameter of the bottom part is beneficial for the contact between the container wall 720 with the clothes, and the contact in clothes, so as to increase the friction force of the clothes during rotation, with consequently the better cleaning effect.

To further improve the cleaning effect, for instance, as shown in FIGS. 17 and 18, the first ribs 721 are interval positioned inside the container wall 720. In that case, on the one hand, the center of gravity of the container body 710 is in the middle so as to cause the rotation of the container body 710 more smoothly and the structure of the container body 710 more stronger; on the other hand, the clothes in the container body 710 are evenly rubbed and contacted, with consequently the better cleaning effect.

Figure 21:
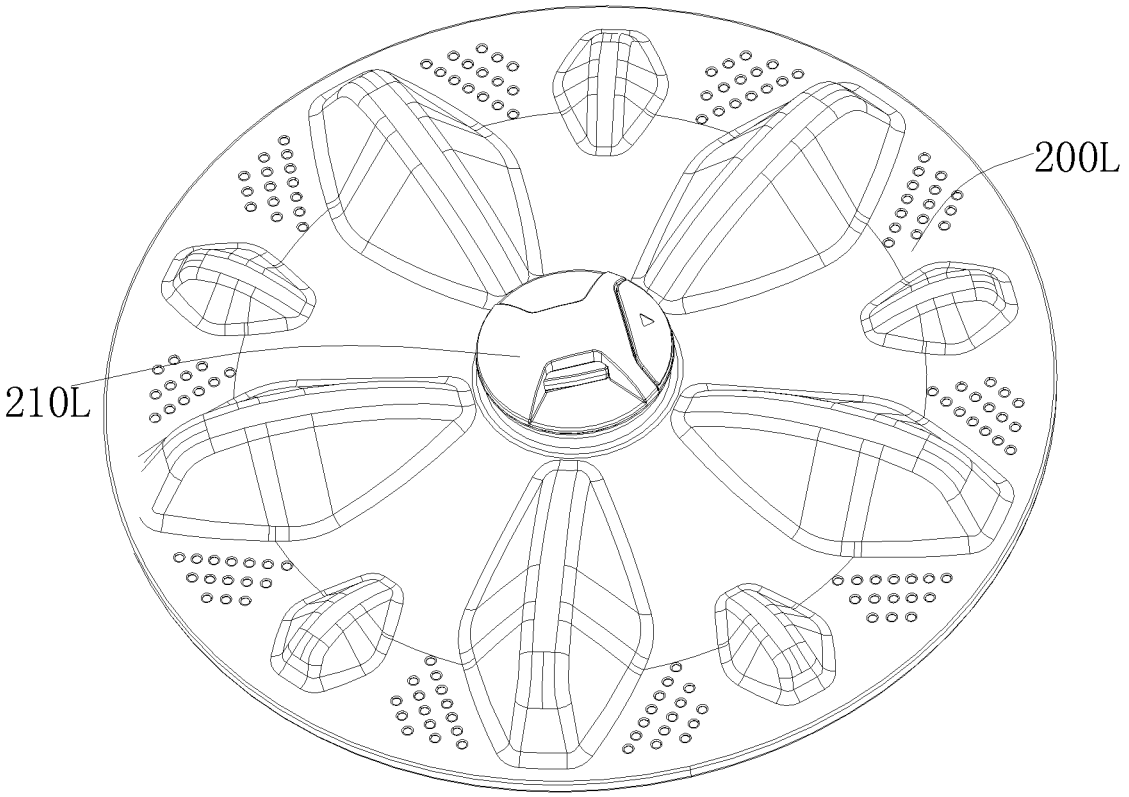
FIG. 21 is a stereoscopic structural diagram of the wave wheel according to the fourth embodiment of the present disclosure.

For instance, as shown in FIG. 21, the present disclosure further includes a wave wheel 200L. A second locking mechanism 210L is carried on the wave wheel 200L. The second locking mechanism 210 can be detachably locked with the drive shaft 300L. When the clothes are too big, with a large volume, a bigger washing space may be needed, the small container 700 is detached from the drive shaft 300L by opening the first locking mechanism 740; then the wave wheel 200L is mounted in the large container 100L, fixing the wave wheel 200L on the drive shaft 300L by using the second locking mechanism 210L. In that case, the large container 100L in the washing machine 10L can wash more clothes, improving the cleaning efficiency. Selectively, the structure of the first locking mechanism 740 is the same as the structure of the second locking mechanism 210L.

Figure 19:
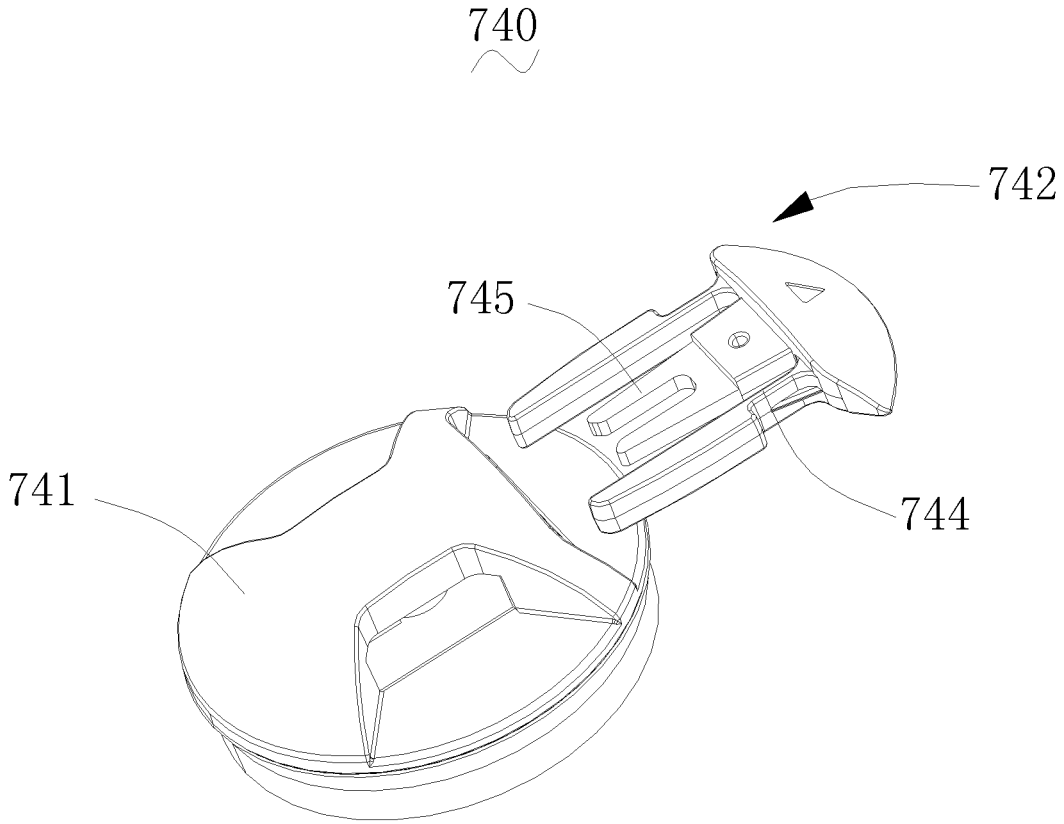
FIG. 19 is a stereoscopic structural diagram of the first locking mechanism according to the fourth embodiment of the present disclosure.
Figure 20:
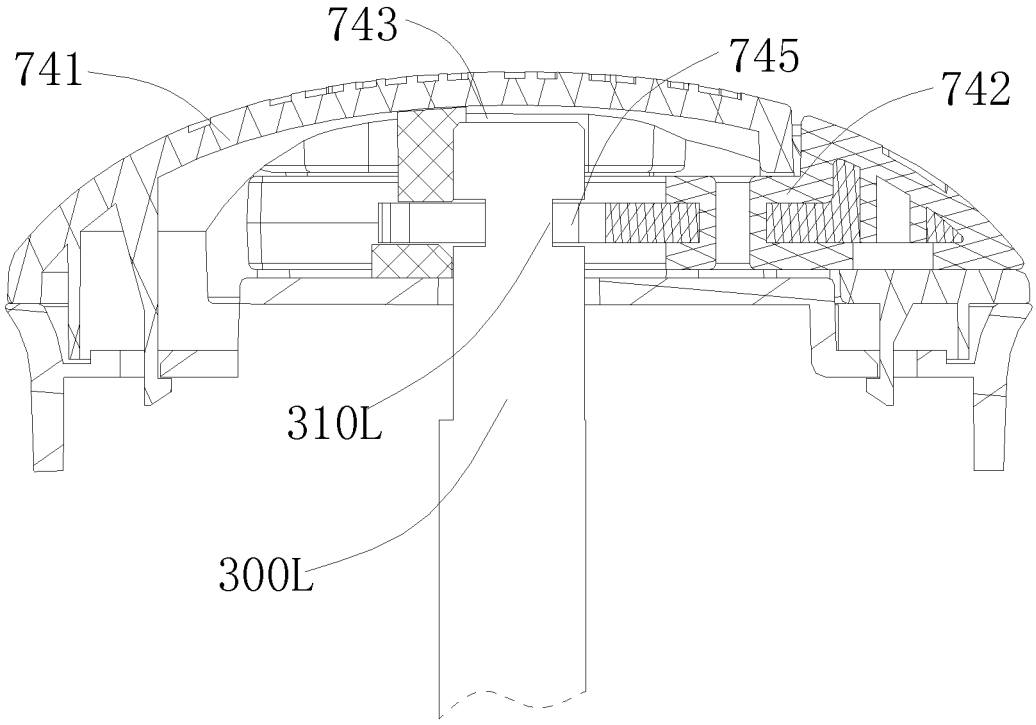
FIG. 20 is a sectional structural diagram of the first locking mechanism and the drive shaft according to the fourth embodiment of the present disclosure.

For instance, as shown in FIGS. 18 and 19, the first locking mechanism 740 includes a locking shell 741 and a locking member 742. The locking shell 741 is fixedly connected with the container bottom 730. As shown in FIG. 20, an accommodating cavity 743 is positioned inside the locking shell 741; the container bottom 730 includes a via hole (not shown) communicated with the accommodating cavity 743, the drive shaft 300L is inserted in the accommodating cavity 743 by using the via hole. As shown in FIG. 20, an end of the drive shaft 300L, inserted in the accommodating cavity 743, has a spline 310L or a positioning recess. The locking member 742 is inserted in the accommodating cavity 743 and connected with the drive shaft 300L. For instance, as shown in FIGS. 19 and 20, the locking member 742 includes a fixing pedestal 744 and two fixing blocks 745 positioned on the fixing pedestal 744. Two sides of the fixing blocks 745, facing with each other, are propped to two sides of the spline 310L of the drive shaft, or propped inside the positioning recess. The other two sides of the fixing blocks 745, are propped to the walls of the accommodating cavity 743. In that case, when the locking member 742 is pulled out from the locking shell 741, the locking shell 741 is separated from the drive shaft 300L, thus the small container 700 can be taken out from the large container 100L; when the small container 700 is assembled in the large container 100L, two fixing blocks 745 of the locking member 742 are fixed with two sides of the spline 310L, thus the container body 710 may be fixedly connected with the drive shaft 300L by means of the first locking mechanism 740. When the drive shaft 300L is driven to rotate by the drive motor 500, the container body 710 may rotate with the rotation of the drive shaft 300L.

Figure 22:
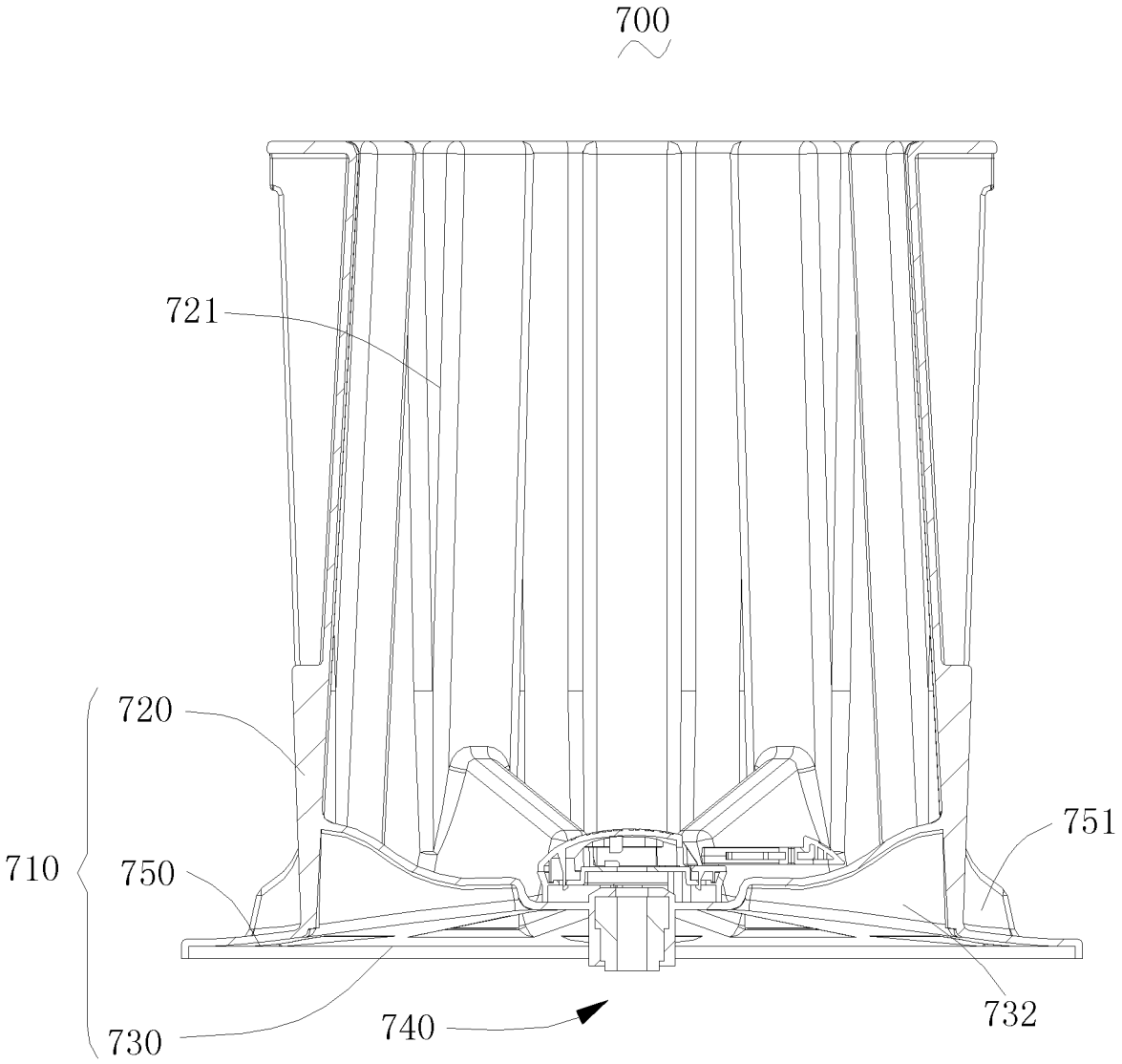
FIG. 22 is an internal structural diagram of the small container according to another embodiment from the fourth embodiment of the present disclosure.
Figure 23:
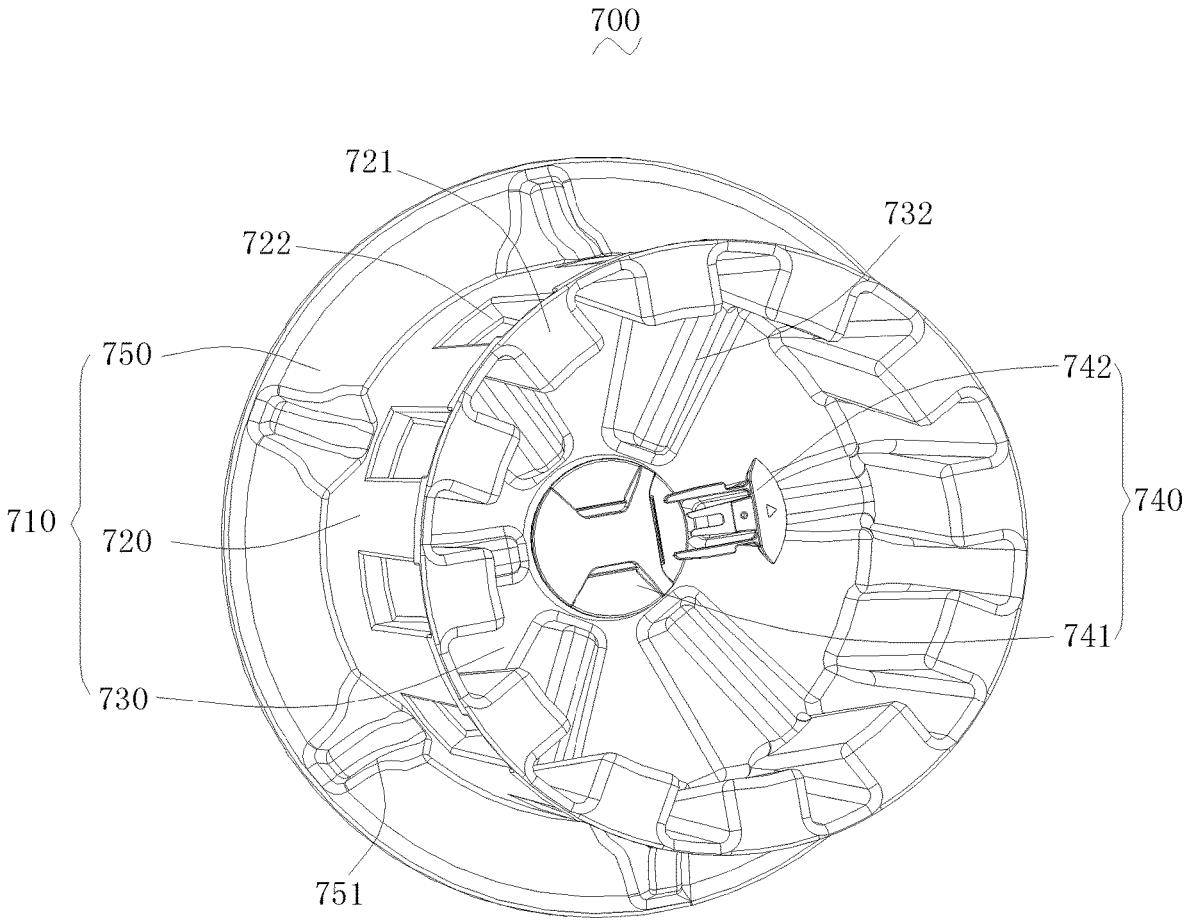
FIG. 23 is a stereoscopic structural diagram of the small container according to another embodiment from the fourth embodiment of the present disclosure.

According to the third embodiment of the present disclosure, furthermore, as shown in FIGS. 22 and 23, the container bottom 730 protrudes along an outside of the container wall 720 to form an outer wave wheel 750. Third ribs 751 are convexly disposed on the outer wave wheel 750. Washing tanks 722 are positioned on the outside of the container wall 720. With reference to FIGS. 16 and 17, the first locking mechanism 740 is detachably locked with the drive shaft 300L. For instance, when washing the clothes in a small volume or quantity, to save water and electricity, the small container 700 may be locked with the drive shaft 300L by means of the first locking mechanism 740 so as to separate the interior of the container body 710 from the exterior. Disposing the clothes in the container body 710 realizes separate washing clothes in the container body 710. Meanwhile, the small volume of the small container 700 may save water and electricity in the washing process. For instance, when needing separate washing of clothes, putting some clothes in the container body 710, the rest clothes are disposed outside the container body 710 in the large container 100L. Thus, the clothes in the container body 710 stir the water by means of the second ribs 732 carried on the container bottom 730, the clothes are rubbed and washed by means of the first ribs 721 carried on the container wall 720. The clothes disposed outside the container body 710 stir the water by means of the third ribs 751, rubbing and washing the clothes by means of the washing tanks 722, which may realize the separate washing of clothes, with consequently a better cleaning effect and health.

To reduce the thickness of the container wall 720 and reduce occupation space of the small container 700, to provide a larger washing space, for instance, as shown in FIG. 23, the washing tanks 722 are concavely disposed on the outside of the container wall 720, and each of the washing tanks 722 is corresponding to each of the second ribs 721. For instance, the container wall 720 concaves from the exterior to the interior, thus the interior protrudes to form the second ribs 721, the exterior is depressed to form the washing tanks 722. Therefore, on one side, the cleaning efficiency is improved, the clothes at both sides of the container wall 720 may be rubbed and washed, on the other side, the thickness of the container wall 720 is reduced and the occupation space of the small container 700 is reduced so as to provide the larger washing space.

The foregoing descriptions are merely embodiments of the present invention, and are not intended to limit the scope of the present invention. An equivalent structural or equivalent process alternation made by using the content of the specification and drawings of the present invention, or an application of the content of the specification and drawings directly or indirectly to another related technical field, shall fall within the protection scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A washing drum comprising:

a large container, comprising a first opening end and a first bottom part positioned opposite to each other;

a wave wheel positioned on the first bottom part, a side of the wave wheel away from the first bottom part protruding to form a positioning column, a cross sectional shape of the positioning column being non-circular; and a small container, comprising a second opening end and a second bottom part positioned opposite to each other;

wherein the small container is detachably disposed in the large container, an opening of the small container and an opening of the large container are positioned opposite to each other, a vertical distance is defined between the first opening end of the large container and the second opening end of the small container, and a gap is between an external wall of the small container and an internal wall of the large container, the large container, the small container, and the positioning column are coaxially arranged, the second bottom part is concaved towards the second opening end to form a groove that is fitted with the positioning column and enabling the positioning column to be inserted into the groove, the positioning column is configured to mount the small container on the wave wheel and provide a power for a rotation of the small container.

2. The washing drum of claim 1, wherein the small container and the wave wheel are formed integrally with the second bottom part of the small container positioned on the wave wheel and the wave wheel detachably positioned on the first bottom part.

3. The washing drum of claim 2, wherein the positioning column is a spline, or the sectional shape of the positioning column is polygon.

4. The washing drum of claim 2, wherein a bevel of the small container tilts outwards, and a diameter of the bevel of the small container is increasing from the second bottom part to the second opening end.

5. The washing drum of claim 2, wherein the positioning column comprises a positioning hole, and a fastener is provided to dispose the wave wheel on the first bottom part via the positioning hole.

6. The washing drum of claim 2, wherein a height of the positioning column is more than or equal to 70 mm.

7. The washing drum of claim 2, wherein the washing drum further includes an anti-slip mat positioned between an exterior of the bottom part of the small container and the wave wheel.

8. The washing drum of claim 2, wherein a water stirring rib is convexly positioned on a side of the wave wheel that faces the first bottom part, and a receiving groove fitted with the water stirring rib is concavely positioned on a side of the second bottom part that faces the wave wheel.

9. The washing drum of claim 2, wherein a bevel of the small container comprises convex ribs.

10. The washing drum of claim 9, wherein the convex ribs are interval arranged on a periphery of the bevel of the small container, and each convex rib extends along an axial direction of the bevel of the small container.

11. A washing machine, comprising: a case of the washing machine, a washing drum, a first power mechanism, a first control device, a second power mechanism and a second control device, wherein the washing drum is disposed in the case, and the washing drum comprises a large container and a small container with the small container detachably disposed in the large container and an opening of the small container and an opening of the large container are disposed opposite to each other, and a gap is between an external wall of the small container and an internal wall of the large container, and the first control device controls the first power mechanism to drive the large container to rotate and the second control device controls the second power mechanism to drive the small container to rotate, the large container comprises a first opening end and a first bottom part positioned opposite to each other, the small container comprises a second opening end and a second bottom part positioned opposite to each other, a vertical distance is defined between the first opening end of the large container and the second opening end of the small container, the washing drum further comprises a wave wheel positioned on the first bottom part, a side of the wave wheel away from the first bottom part protrudes to form a positioning column, a cross sectional shape of the positioning column is non-circular, the large container, the small container, and the positioning column are coaxially arranged, the second bottom part is concaved towards the second opening end to form a groove that is fitted with the positioning column and enabling the positioning column to be inserted into the groove, the positioning column is configured to mount the small container on the wave wheel and provide a power for a rotation of the small container.

12. A washing drum comprising:

a large container, comprising a first opening end and a first bottom part positioned opposite to each other; and a wave wheel positioned on the first bottom part, a side of the wave wheel away from the first bottom part protruding to form a positioning column, a sectional shape of the positioning column being non-circular; and a small container, comprising a second opening end and a second bottom part positioned opposite to each other;

wherein the small container is detachably disposed in the large container, an opening of the small container and an opening of the large container are positioned opposite to each other, and a gap is between an external wall of the small container and an internal wall of the large container, the second bottom part is concaved towards the second opening end to form a groove that is fitted with the positioning column and enabling the positioning column to be inserted into the groove, or the small container and the wave wheel are formed integrally with the second bottom part of the small container positioned on the wave wheel and the wave wheel detachably positioned on the first bottom part, a bevel of the small container tilts outwards, and a diameter of the bevel of the small container is increasing from the second bottom part to the second opening end.

13. The washing drum of claim 12, wherein the positioning column is a spline, or the sectional shape of the positioning column is polygon.

14. The washing drum of claim 12, wherein the positioning column comprises a positioning hole, and a fastener is provided to dispose the wave wheel on the first bottom part via the positioning hole.

15. The washing drum of claim 12, wherein a height of the positioning column is more than or equal to 70 mm.

16. The washing drum of claim 12, wherein the washing drum further includes an anti-slip mat positioned between an exterior of the second bottom part of the small container and the wave wheel.

17. The washing drum of claim 12, wherein a water stirring rib is convexly positioned on a side of the wave wheel that faces the first bottom part, and a receiving groove fitted with the water stirring rib is concavely positioned on a side of the second bottom part that faces the wave wheel.

18. The washing drum of claim 12, wherein a bevel of the small container comprises convex ribs.

19. The washing drum of claim 18, wherein the convex ribs are interval arranged on a periphery of the bevel of the small container, and each convex rib extends along an axial direction of the bevel of the small container.

* * * * *